US008001775B2

(12) United States Patent
Krajewski et al.

(10) Patent No.: US 8,001,775 B2
(45) Date of Patent: Aug. 23, 2011

(54) VEHICLE EXHAUST DILUTION AND DISPERSION DEVICE

(75) Inventors: Jason T. Krajewski, Portland, OR (US); Bhaskar Keshav Bhatnagar, Hillsboro, OR (US)

(73) Assignee: Daimler Trucks North America LLC, Porland, OR (US)

( * ) Notice: Subject to any disclaimer, the term of this patent is extended or adjusted under 35 U.S.C. 154(b) by 1457 days.

(21) Appl. No.: 11/442,365

(22) Filed: May 26, 2006

(65) Prior Publication Data

US 2007/0039318 A1 Feb. 22, 2007

Related U.S. Application Data

(60) Provisional application No. 60/709,039, filed on Aug. 16, 2005, provisional application No. 60/765,238, filed on Feb. 3, 2006.

(51) Int. Cl.
*F01N 3/02* (2006.01)

(52) U.S. Cl. ..... 60/317; 60/274; 60/298; 60/319; 60/324

(58) Field of Classification Search ..... 60/274, 60/317, 319, 323, 324, 298; 181/227, 228, 181/239, 243, 259, 261
See application file for complete search history.

(56) References Cited

U.S. PATENT DOCUMENTS

| | | | | |
|---|---|---|---|---|
| 1,521,047 | A | | 12/1924 | Reynolds |
| 2,123,858 | A | | 7/1938 | Wightman |
| D112,482 | S | * | 12/1938 | Koch ..... D12/194 |
| 2,192,922 | A | | 3/1940 | Lyon |
| 2,252,228 | A | | 8/1941 | Koch, Jr. |
| 2,260,841 | A | | 10/1941 | Russell |
| 2,308,059 | A | * | 1/1943 | Decker ..... 239/427.3 |
| 2,355,674 | A | | 8/1944 | Peters et al. |
| 2,466,307 | A | | 4/1949 | Di Renna |
| D158,848 | S | * | 6/1950 | Follen ..... D12/194 |
| 2,693,863 | A | | 11/1954 | Walker |
| 2,754,138 | A | | 7/1956 | Kramer |
| 2,864,406 | A | | 12/1958 | Schewel |
| 2,865,169 | A | | 12/1958 | Hausmann |

(Continued)

FOREIGN PATENT DOCUMENTS

DE 819642 11/1951

(Continued)

OTHER PUBLICATIONS

International Search Report from PCT/US06/32069.

(Continued)

*Primary Examiner* — Tu M Nguyen
(74) *Attorney, Agent, or Firm* — Klarquist Sparkman, LLP

(57) ABSTRACT

In one exemplary embodiment, an exhaust dilution and dispersion device for a vehicle can include a generally elongate tailpipe including an inlet section capable of being in exhaust receiving communication with an exhaust system of a vehicle. The tailpipe further includes an outlet section in exhaust receiving communication with the inlet section. The outlet section can also include a downwardly directed exhaust deflection portion and an exhaust outlet in exhaust dispersing communication with the surroundings external to the device. The exhaust outlet can include a generally elongate exhaust dispersion opening extending in a lengthwise direction along the tailpipe. At least a portion of the exhaust outlet can be coextensive with the downwardly directed exhaust deflecting portion and a major portion of the exhaust dispersed from the outlet can have a transverse component.

38 Claims, 19 Drawing Sheets
(8 of 19 Drawing Sheet(s) Filed in Color)

U.S. PATENT DOCUMENTS

| | | | | |
|---|---|---|---|---|
| 3,110,358 | A | 11/1963 | Ludlow et al. | |
| 3,592,292 | A | 7/1971 | Lavallee | |
| 3,949,550 | A | 4/1976 | Albrecht et al. | |
| 3,981,449 | A | 9/1976 | Krey et al. | |
| D247,360 | S | 2/1978 | Hamaguchi et al. | |
| 4,183,896 | A | 1/1980 | Gordon | |
| 4,310,067 | A | 1/1982 | Thomson | |
| 4,390,079 | A | 6/1983 | Brill | |
| 4,504,238 | A | 3/1985 | Neisen | |
| 4,544,098 | A | 10/1985 | Warburton | |
| 4,742,961 | A | 5/1988 | Starke | |
| 5,058,703 | A | 10/1991 | Ealba et al. | |
| 5,265,408 | A | 11/1993 | Sheoran et al. | |
| 5,280,143 | A | 1/1994 | Kakuta | |
| D351,579 | S * | 10/1994 | Simpson | D12/194 |
| 5,466,900 | A | 11/1995 | Knapp | |
| 5,508,478 | A | 4/1996 | Barry | |
| 5,881,554 | A | 3/1999 | Novak et al. | |
| 5,983,628 | A | 11/1999 | Borroni-Bird et al. | |
| 6,000,635 | A | 12/1999 | Justice | |
| 6,035,633 | A | 3/2000 | Woods | |
| 6,230,488 | B1 | 5/2001 | Voss | |
| D458,570 | S | 6/2002 | Wang | |
| 6,471,377 | B1 | 10/2002 | Stegall | |
| 6,588,545 | B1 | 7/2003 | Lee | |
| 6,595,318 | B2 | 7/2003 | Ebinger et al. | |
| 6,609,590 | B2 | 8/2003 | Zelinski | |
| 6,640,927 | B1 | 11/2003 | Turner | |
| 6,647,970 | B2 | 11/2003 | Hankins | |
| 6,729,122 | B2 | 5/2004 | Watanabe et al. | |
| 6,800,004 | B1 | 10/2004 | White et al. | |
| 6,804,949 | B2 | 10/2004 | Andrews et al. | |
| 6,910,930 | B1 | 6/2005 | Mitchell | |
| 7,604,093 | B2 * | 10/2009 | Bach | 181/228 |
| 2004/0206573 | A1 | 10/2004 | Hsu | |

FOREIGN PATENT DOCUMENTS

| | | | |
|---|---|---|---|
| FR | 1118381 | A | 6/1956 |

OTHER PUBLICATIONS

European Extended Search Report dated Jul. 5, 2010, issued in corresponding European Patent Application No. EPC 06801686.4, filed Aug. 16, 2006.

* cited by examiner

| | Predicted CFD | | | | | |
|---|---|---|---|---|---|---|
| | Device I (Figures 1-9) | | Device II (Figures 18-22) | | Conv. Tailpipe | |
| Testing Plane | 140 mm (5.5 inch) | 300 mm (11.8-inch) | 140 mm (5.5 inch) | 300 mm (11.8-inch) | 140 mm (5.5 inch) | 300 mm (11.8-inch) |
| Inlet Temp (C) | 650 | 650 | 650 | 650 | 650 | 650 |
| Exhaust Flow Velocity (m/s) | 70 | 70 | 70 | 70 | 70 | 70 |
| Wind Speed (m/s) | 0 | 0 | 0 | 0 | 0 | 0 |
| Ambient Air Temp (C) | 25 | 25 | 25 | 25 | 25 | 25 |
| Length (in.) | 17 | 17 | 30 | 30 | 12.75 | 12.75 |
| Pipe Diameter (in.) | 5 | 5 | 6 | 6 | 5 | 5 |
| Max Temp @ Plane (C) | **305** | **233** | **467** | **346** | **524** | **467** |

FIG. 12a

| | Measured | | | | | |
|---|---|---|---|---|---|---|
| | Device I (Figures 1-9) | | Device II (Figures 18-22) | | Conv. Tailpipe | |
| Testing Plane | 6 inch | 16 inch (ground) | 6 inch | 15.5 inch (ground) | 6 inch | 16 inch (ground) |
| Inlet Temp (C) | ~550 | ~550 | ~520 | ~520 | ~600 | ~600 |
| Exhaust Flow Velocity (m/s) | 18 | 18 | 40 | 40 | 18 | 18 |
| Wind Speed (m/s) | 0 | 0 | 0 | 0 | 0 | 0 |
| Ambient Air Temp (C) | 10 | 10 | 18 | 18 | 10 | 10 |
| Length (in.) | 17 | 17 | 30 | 30 | 12.75 | 12.75 |
| Pipe Diameter (in.) | 5 | 5 | 6 | 6 | 5 | 5 |
| Max Temp @ Plane (C) | **198** | **42** | **310** | **186** | **430** | **203** |

FIG. 12b

| | Validating CFD | | | |
|---|---|---|---|---|
| | Device I (Figures 1-9) | | Device II (Figures 18-22) | |
| Testing Plane | 6 inch | 16 inch (ground) | 6 inch | 16 inch (ground) |
| Inlet Temp (C) | ~550 | ~550 | ~520 | ~520 |
| Exhaust Flow Velocity (m/s) | 18 | 18 | 40 | 40 |
| Wind Speed (m/s) | 0 | 0 | 0 | 0 |
| Ambient Air Temp (C) | 10 | 10 | 18 | 18 |
| Length (in.) | 17 | 17 | 30 | 30 |
| Pipe Diameter (in.) | 5 | 5 | 6 | 6 |
| Max Temp @ Plane (C) | **258** | **155** | **369** | **242** |

FIG. 12c

VEHICLE EXHAUST DILUTION AND DISPERSION DEVICE

CROSS REFERENCE TO RELATED APPLICATION

This application claims the benefit of U.S. Provisional Application No. 60/709,039, filed Aug. 16, 2005, and U.S. Provisional Application No. 60/765,238, filed Feb. 3, 2006, both of which are incorporated herein by reference.

FIELD

This invention relates to an exhaust system for a vehicle, and in particular, a vehicle exhaust dilution and dispersion device.

BACKGROUND

The temperature of exhaust dispersed from a vehicle's tailpipe outlet at a certain distance away from the outlet must meet certain industry safety standards.

Some modern internal combustion engines for use with vehicles, such as diesel engines, are being equipped with devices to burn particulates in exhaust gases to reduce environmental pollutants. Use of such devices can result in hotter exhaust gas than engines running without the devices. But even without using such a burning device, some modern engines are operable to produce hotter exhaust gas then older engines. For example, some engines are or will be capable of producing exhaust gas at or above 1200° F. Known passive exhaust gas systems may not be able to sufficiently reduce the exhaust gas temperature to meet industry standards.

SUMMARY

The present disclosure is directed toward all new and non-obvious features and method acts disclosed herein both alone and in novel and non-obvious combinations and sub-combinations with one another. The disclosure is not limited to constructions which exhibit all of the advantages or components disclosed herein. The embodiments set forth herein provide examples of desirable constructions and are not to be construed as limiting the breadth of the disclosure.

Described herein are embodiments of a vehicle exhaust dilution and dispersion device used as an after-treatment element of a vehicle's exhaust system. The exhaust dilution and dispersion device can facilitate a more rapid temperature reduction of exhaust dispersed into the atmosphere from the exhaust system than conventional exhaust systems. Since the exhaust dilution and dispersion device preferably provides temperature reduction characteristics, the vehicle exhaust dilution and dispersion device can be termed an exhaust cooling device.

In one exemplary embodiment, an exhaust dilution and dispersion device for a vehicle can include a generally elongate tailpipe comprising an inlet section capable of being in exhaust receiving communication with an exhaust system of a vehicle. The tailpipe further comprises an outlet section in exhaust receiving communication with the inlet section. The outlet section can also comprise a downwardly directed exhaust deflection portion and an exhaust outlet in exhaust dispersing communication with the surroundings external to the device. The exhaust outlet can comprise a generally elongate exhaust dispersion opening extending in a lengthwise direction along the tailpipe. At least a portion of the exhaust outlet can be coextensive with the downwardly directed exhaust deflecting portion and a major portion of the exhaust dispersed from the outlet can have a transverse component.

In some implementations, the tailpipe can comprise a length of pipe having a generally cylindrical shape with a major diameter and the elongate opening can have, for example, a width that is at least approximately 75% of the major diameter of the tailpipe. In some implementations, the elongate opening can have a height in a side profile that is at least approximately 25% of the major diameter of the tailpipe. In some implementations, the elongate opening can have a length that is at least approximately 50% of the length of the tailpipe. In yet some implementations, a substantial portion of the perimeter of the elongate opening can extend approximately parallel to a central axis of the tailpipe. In certain implementations, the elongate opening can have a generally elongate inverted U-shaped profile.

In some implementations, at an end of the tailpipe, the downwardly directed exhaust deflection portion can define an angle of between approximately 130° and approximately 150° with respect to a central axis of the tailpipe.

In some implementations, the downwardly directed exhaust deflection portion can comprise, for example, a bifurcated section having at least one inwardly projecting deflector and at least one outwardly projecting exhaust flow guide. In specific implementations, an interior surface of the at least one deflector can be generally convex and an interior surface of the at least one exhaust flow guide can be generally concave. In some implementations, the downwardly directed exhaust deflection portion can comprise at least two outwardly projecting exhaust flow guides and one inwardly projecting deflector, where the inwardly projecting deflector is disposed intermediate the at least two outwardly projection flow guides. In certain implementations, the bifurcated section has at least one symmetry plane.

In some implementations, the downwardly directed exhaust deflection portion can comprise at least one inwardly projecting deflector having increasing interior surface areas in an exhaust flow direction and an at least one outwardly projecting flow guide defining an exhaust flow channel that has decreasing cross-sectional areas in the exhaust flow direction.

In some implementations, the exhaust dilution and dispersion device can comprise a nozzle having a first exhaust inlet end portion connectable to an exhaust system of a vehicle and a second exhaust acceleration end portion generally opposite the first exhaust inlet end portion and having reduced cross-sectional areas in an exhaust flow direction. The second exhaust acceleration end portion of the nozzle can be at least partially disposed within the first end portion of the tailpipe such that an ambient air passageway is defined between an outer surface of the nozzle and an interior surface of the tailpipe. This ambient air passageway can facilitate passage of ambient air from the surroundings into the exhaust flowing through the tailpipe. In specific implementations, the ambient air passageway can be, for example, generally annularly-shaped.

In specific implementations, the tailpipe can comprise a diffusion section intermediate the second exhaust accelerating end portion of the nozzle and the exhaust dispersion opening. The diffusion section can have increasing cross-sectional areas in the exhaust flow direction.

In specific implementations, the exhaust dilution and dispersion device can have a plurality of connection structures, such as gussets, coaxially coupling the nozzle and the tailpipe together. The connection structures can be generally elongated and extend in a direction generally parallel to a central axis of the nozzle. Further, in some implementations, the connection structures can have a turbulence inducing portion that is not parallel to a central axis of the tailpipe.

In another exemplary embodiment, an exhaust cooling tailpipe for a vehicle can comprise a first generally tubular inlet portion with an exhaust inlet capable of being in exhaust receiving communication with an exhaust system of a vehicle and a second outlet portion coupled to the inlet portion. The second outlet portion can comprise a downwardly directed exhaust deflection portion having a bifurcated section. The bifurcated section can have at least one inwardly projecting deflector with increasing interior surface areas in an exhaust flow direction and at least one outwardly projecting exhaust flow guide with decreasing cross-sectional areas in the exhaust flow direction. The deflector can be coextensive with the at least one flow guide. The second outlet portion can also comprise an exhaust outlet in exhaust dispersing communication with the environment. The exhaust outlet can comprise a generally elongate opening that extends longitudinally along the tailpipe and is coextensive with the downwardly directed exhaust deflecting portion such that at least a major portion of the exhaust is dispersed through the opening in a direction lateral to the tailpipe.

In one exemplary embodiment, an exhaust dilution and dispersion device for a vehicle can include an exhaust accelerating portion for mounting in exhaust receiving communication with a vehicle. The acceleration portion can have an exhaust acceleration passage of reduced cross-sectional areas to accelerate the exhaust flow therethrough. The exhaust acceleration passage can, for example, comprise an exhaust acceleration section having a passage with converging side walls in an exhaust flow direction.

The exhaust dilution and dispersion device can also include an exhaust diffusion portion in exhaust receiving communication with the exhaust accelerating passage of the exhaust accelerating portion. The exhaust diffusion portion can have an expansion portion of increased cross-sectional area. The exhaust diffusion portion can, for example, comprise an exhaust diffusion passage of increased cross-sectional areas to facilitate expansion of the exhaust.

The exhaust dilution and dispersion device can further include an air passageway having a first portion communicating with or exposed to ambient air and a second portion communicating with or exposed to the exhaust diffusion portion so as to introduce ambient air (air outside the exhaust dilution and dispersion device) into the exhaust diffusion portion.

The device can also include an exhaust dispersion portion in exhaust receiving communication with the exhaust diffusion passage and having a generally elongate exhaust dispersion opening extending in a lengthwise direction and in exhaust expelling communication with the surrounding environment. The exhaust dispersion opening is configured to laterally disperse at least a major portion of exhaust.

In specific implementations, the exhaust dispersion opening can have a generally elongate arcuate-shaped profile.

In certain implementations, the exhaust accelerating passage can be coaxial with and at least partially positioned within the exhaust diffusion passage of the exhaust diffusion portion. In these implementations, the air passageway can, for example, include a generally annularly-shaped passage formed between the exhaust accelerating portion and the exhaust diffusion portion.

In some implementations, the exhaust accelerating portion can be coupled to the exhaust diffusion portion such as via support or coupling structures with one specific example being a plurality of gussets. In specific implementations, each of the plurality of gussets can extend approximately parallel to and in the same general direction as a central axis of the exhaust accelerating passage and the exhaust diffusion passage. In other specific implementations, at least one of the plurality of gussets can extend at an angle relative to, or otherwise not parallel to, a central axis of the exhaust accelerating passage and the exhaust diffusion passage.

In some implementations, the exhaust accelerating portion can include a first generally tubular-shaped pipe and the exhaust diffusion portion can include a second generally tubular-shaped pipe. The first generally tubular-shaped pipe can be positioned at least partially within the second generally tubular-shaped pipe and the air passageway can include a space defined between the first pipe and the second pipe. In certain implementations, the first generally tubular-shaped pipe can have an inlet end and an outlet end where the inlet end is adapted for mounting in exhaust receiving communication with a vehicle exhaust system of the vehicle and the outlet end is in exhaust expelling communication with the second generally tubular-shaped pipe.

In some implementations, the exhaust dilution and dispersion device can include a mixing portion intermediate the exhaust diffusion portion and the exhaust dispersion portion. The mixing portion can have a passageway with a side wall generally parallel to the exhaust flow direction. Further, the mixing portion can be in exhaust receiving communication with the diffusion portion and exhaust expelling communication with the exhaust dispersion portion.

In some implementations, the diffusion portion can be generally seamlessly connected to the dispersion portion.

In one exemplary embodiment, a method of cooling exhaust from a vehicle can comprise receiving a flow of exhaust from an exhaust system of a vehicle, downwardly deflecting at least a portion of the flow of exhaust, and dispersing the flow of exhaust away from the vehicle. Dispersing the flow of exhaust can comprise downwardly dispersing the flow of exhaust and laterally dispersing at least a major portion of the flow of exhaust.

In some implementations, the method can further comprise bifurcating at least a portion of the flow of exhaust.

In some implementations, the method can comprise accelerating the flow of exhaust received from the exhaust system and mixing ambient air with the flow of exhaust prior to dispersing the exhaust. In specific implementations, the method can further include decelerating the flow of exhaust after mixing ambient air with the flow of exhaust.

The foregoing and other features and advantages will become more apparent from the following detailed description, which proceeds with reference to the accompanying figures.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIGS. 12*a*-12*c* are tables of testing conditions and results for various tests performed on simulated and physical embodiments of the devices described herein.

In the following detailed description and claims, spacially orienting terms such as "horizontal," "vertical," "upper," "lower," "downwardly" and "upwardly" are used. Unless otherwise noted, it is to be understood that these terms are for convenience of description with respect to the drawings and not themselves necessarily limiting of the orientation of any given component in space.

DETAILED DESCRIPTION

An exhaust dilution and dispersion device, e.g., exhaust cooling device, for diluting and dispersing exhaust from a vehicle's exhaust system is described herein. As will be described in more detail, the device can reduce the maximum temperature of exhaust gas dispersed from the device, such as at a specific distance from the device outlet. The exhaust dilution and dispersion device can comprise, for example, a generally elongate, downwardly facing, opening and downwardly directed deflection portion for producing a wide multi-directional dispersion of exhaust exiting the opening. In some implementations, the device opening disperses at least a major portion of exhaust laterally from the device. The opening can provide many advantages, such as, for example, accentuated multi-directional dispersion of exhaust gas, additional engine back-pressure relief and decreased tailpipe weight.

Figure 1A:
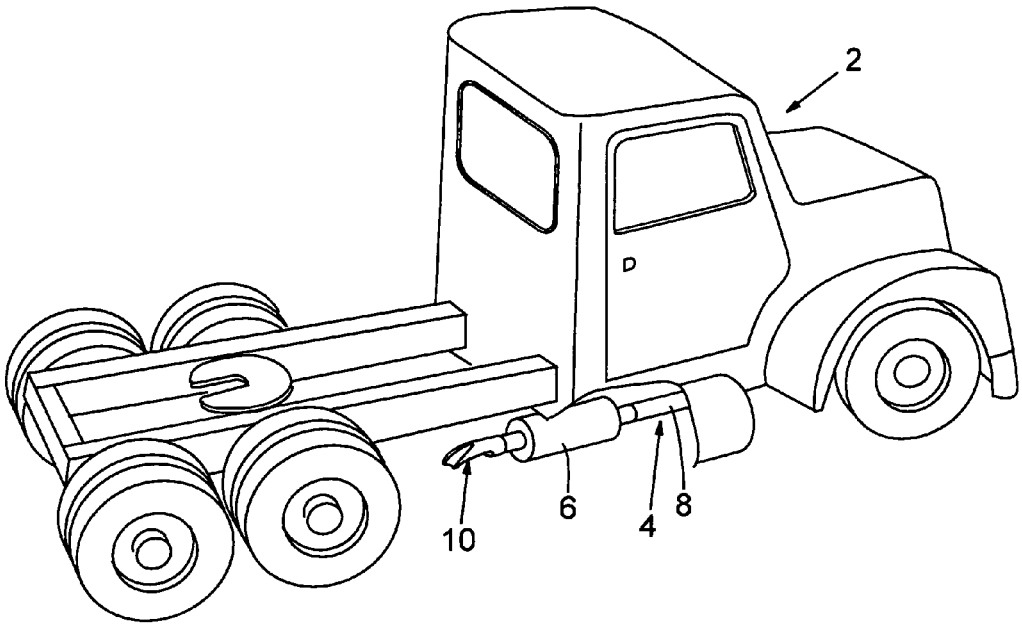
FIG. 1*a* is a perspective view of an exemplary embodiment of an exhaust dilution and dispersion device coupled to an exhaust system of a vehicle.

Referring to FIG. 1*a*, according to one exemplary implementation, an exhaust dilution and dispersion device can be coupled to an exhaust system of a vehicle at any of various locations within or along the exhaust system. Truck 2, being exemplary of vehicles known in the art, can include an exhaust system 4 having an after-treatment device, such as muffler 6, and an exhaust conduit, such as exhaust pipe 8, coupling the after-treatment device and the vehicle's engine (not shown). Exhaust from the vehicle's engine flows through the conduit, into the muffler, and dispersed into the atmosphere. As shown in FIG. 1*a*, a portion of the vehicle has been removed to reveal an exhaust dilution and dispersion device, such as exhaust dilution and dispersion device 10, coupled to the muffler 6 of the exhaust system 4. In this manner, an exhaust dilution and dispersion device, such as device 10, can receive exhaust from the muffler and dilute and disperse it as will be described in more detail below.

Although the vehicle shown is a semi-trailer truck 2, it is recognized that the exhaust dilution and dispersion device, as will be described in more detail hereafter, can be coupled to the exhaust system of other types of vehicles including, but not limited to, passenger cars, tractors, planes and recreational vehicles. The exhaust dilution and dispersion device of the present disclosure can also be used with equipment having a combustible engine with an exhaust system, such as, but not limited to, diesel generators.

The exhaust dilution and dispersion device can be mounted to a vehicle or equipment in a variety of orientations. For example, as shown in FIG. 1*a*, the exhaust dilution and dispersion device, such as exhaust dilution and dispersion device 10, can be mounted horizontally relative to the ground. In other implementations, the exhaust dilution and dispersion device can be mounted vertically relative to the ground or any other angle relative to the ground. Also, the device can be mounted in any of various orientations about its axis such that the device outlet faces in any of a variety of directions.

The exhaust dilution and dispersion device can be mounted to a vehicle or equipment at any of a variety of locations. For example, in some implementations, such as shown in FIG. 1*a*, when mounted to a vehicle, the exhaust dilution and dispersion device can be disposed at a location approximately midway along the length of the vehicle and below the frame of the vehicle. It is also recognized that in some implementations, the exhaust dilution and dispersion device can be disposed above the frame of the vehicle and can be proximate the top of the vehicle. The exhaust dilution and dispersion device can be mounted at an inboard location, e.g., mounted to an interior portion of the vehicle, or at an outboard location, e.g., mounted to an exterior portion of the vehicle. Also, the exhaust dilution and dispersion device need not be positioned midway along the length of a vehicle as shown, but can be disposed proximate, or anywhere between, the front or rear portions of a vehicle.

Figure 1B:
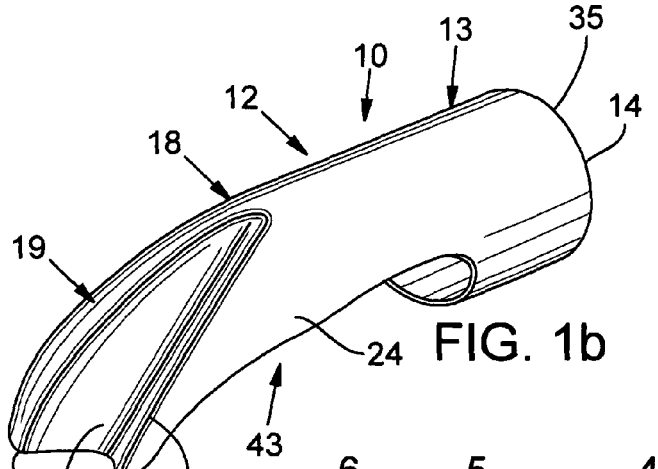
FIG. 1*b* is a perspective view of the exhaust dilution and dispersion device of FIG. 1*a*.

Referring to FIG. 1*b*, exhaust dilution and dispersion device 10 comprises a tailpipe, or tailpipe portion, 12 having an exhaust inlet section, or portion, 13 and an exhaust outlet section, or portion, 18 coupled to the exhaust inlet section. The exhaust inlet section 13 comprises a length of tubing, such as cylindrical tubing having a generally circular cross-section, and an exhaust inlet opening 35 at a first end 14 of the tailpipe 12. The exhaust inlet section 13 can be coupled to a portion of a vehicle's exhaust system by known coupling techniques, such as by welding or through use of conventional fasteners or pipe couplings, such that the exhaust inlet opening 35 is in exhaust receiving communication with the exhaust system of the vehicle. In some implementations, the exhaust inlet section 13 can include a flanged portion (not shown) or other portion or attachment proximate the first end 14 for facilitating coupling the tailpipe 12 to the exhaust system of a vehicle.

Figure 3:
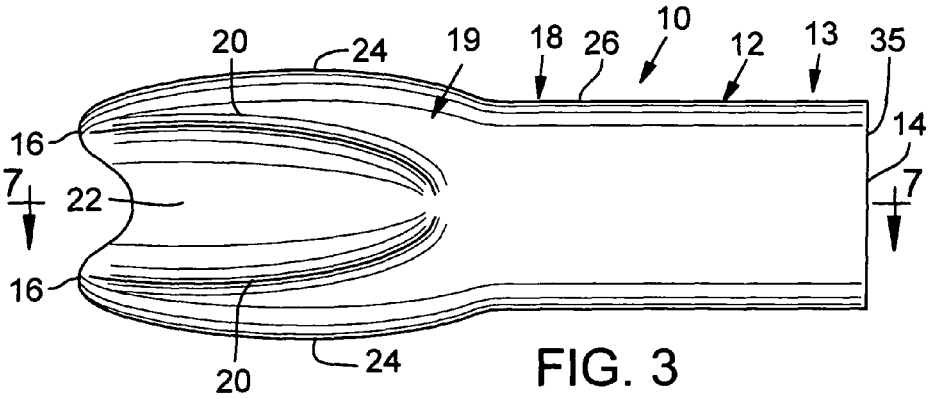
FIG. 3 is a top view of the device of FIG. 1*a*.
Figure 4:
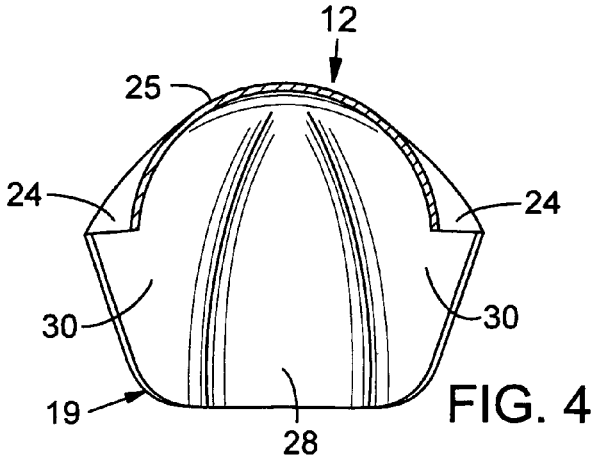
FIG. 4 is a cross-sectional view of the device of FIG. 1*a* taken along the line 4-4 of FIG. 2.

The exhaust outlet section 18 comprises a neck portion 26 coupled to the exhaust inlet section 13 and a bifurcated end, deflection, or baffle, portion 19 coupled to the neck portion. As best shown in FIG. 4, the neck portion 26 comprises a length of pipe having a generally semi-circular shaped cross-section. In some implementations, the neck portion 26 can be seamlessly connected to the tailpipe inlet section 13 and the semi-circular shaped cross-section of the neck portion can be coextensive with the cross-section of the inlet section. More specifically, the tailpipe inlet section 13 and the tailpipe outlet section 18, including the neck portion 26, can be formed from a single length of pipe to form a monolithic one-piece construction. As perhaps best shown in FIG. 3, the bifurcated end portion 19 can comprise flared side portions 24 extending laterally away from the outer periphery of the neck portion 26.

In the exemplary embodiment, the bifurcated end portion 19 comprises a formed end having, for example, a pair of exhaust flow guides 20 and a flow guide divider 22 disposed intermediate and separating the exhaust flow guides 20. The exhaust flow guides 20 and flow guide divider 22 extend from an upper portion of the tailpipe 12 in a downwardly direction toward the second end 16 of the tailpipe. The innermost interior surface 28 of the flow guide divider 22 is downwardly directed in the exhaust flow direction, i.e., a direction extending from the first end 14 towards the second end 16 of the tailpipe 12, at an angle of β with respect to a central axis A of the tailpipe 12, i.e., an axis that is concentric with the tailpipe inlet section 10 (see FIG. 7). In some implementations, the angle β can be between approximately 90° and approximately 180°. Preferably, in more specific implementations, the angle β can be between approximately 130° and 150°.

Figure 5:
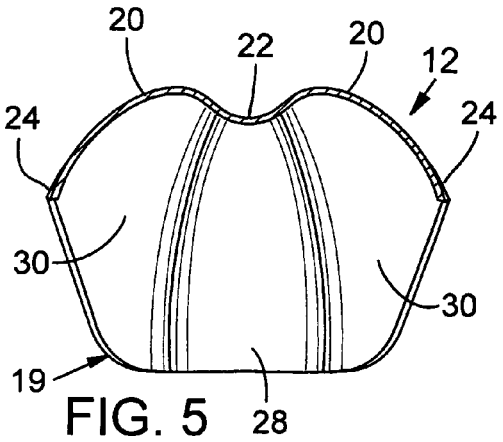
FIG. 5 is a cross-sectional view of the device of FIG. 1*a* taken along the line 5-5 of FIG. 2.
Figure 6:
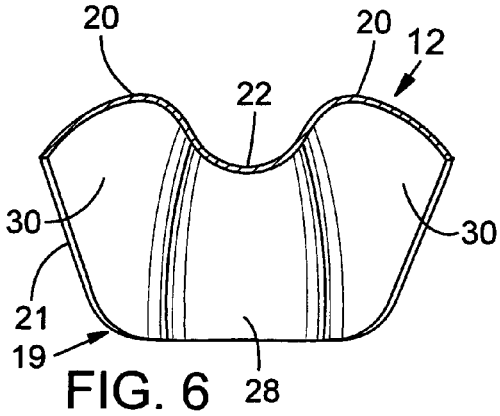
FIG. 6 is a cross-sectional view of the device of FIG. 1*a* taken along the line 6-6 of FIG. 2.

Perhaps best shown in FIGS. 5 and 6, in the exemplary implementations, the flow guides 20 and flow guide divider 22 are seamlessly connected to form a one-piece construction having a generally "M-shaped" or undulating cross-section. The flow guides 20 can each comprise, for example, an outwardly directed bump or protrusion and the flow guide divider 22 can comprise, for example, an inwardly directed indentation, protrusion or bump. As defined herein, outwardly refers to a direction extending generally away from the central axis A or, alternatively, the exhaust flow path and inwardly refers to a direction extending generally toward the central axis A or, alternatively, into the exhaust flow path.

The interior surface of each of the flow guides 20 define an exhaust flow channel 30 through which a portion of the exhaust flowing through the tailpipe 12 is allowed to flow. The interior surface of the flow guides 20 and respective channels 30 can be, for example, generally concave. In specific implementations, the channels 30 can have decreasing cross-sectional areas in the exhaust flow direction. The interior surface of the flow guide divider 22 can be, for example, generally convex to partition the respective channels 30 of the flow guides 20. As shown, the flow guide divider 22 can have, for example, increasing lateral major dimensions or widths, e.g., increasing interior surface areas, moving in the exhaust flow direction. Although the interior surfaces of the flow guides 20 and guide divider 22 are concave and convex, respectively, it is recognized that the interior surfaces can be other than concave and convex. For example, the interior surfaces can be triangular, rectangular or polygonal.

Although two flow guides 20 having a respective channel 30 and one divider 22 are shown, it is recognized that in some implementations, more or less than two flow guides 20 can be used and more than one divider 22 can be used. For example, the bifurcated end portion could have a generally "clam shell" shape or fan-like shape with a plurality of flow guides and a plurality of dividers each disposed intermediate a respective pair of the plurality of flow guides.

The bifurcated end portion 19 shown has at least one symmetrical plane, i.e., a plane that divides the opening in such a way that the points on one side of the plane are equivalent to the points on the other side by reflecting through the plane. For example, in the illustrated embodiments, a symmetrical plane of the bifurcated end portion 19 is a vertical plane extending parallel to and through axis A. Although in the preferred embodiments, the bifurcated end portion has a plane of symmetry, it is recognized that in some embodiments, the bifurcated end portion need not have a plane of symmetry. For example, in certain applications, e.g., where it is desirable to disperse more exhaust to one side of the device than the other, the bifurcated end portion could have, for example, one flow guide 20 on a first side of the bifurcated end portion and two or more flow guides 20 on a second side of the bifurcated end portion, or a flow guide divider 22 that is off-set with respect to axis A.

The outlet section 18 of the device 10 includes an elongate exhaust dispersion opening 43 extending longitudinally from the neck portion 16 to the second end 16 of the tailpipe. Preferably, at least a portion of the exhaust dispersion opening is coextensive with or adjacent the bifurcated end portion 19. As used herein, coextensive can be defined generally to mean in close proximity or sharing a general boundary, edge, or space. As used herein, coextensive can also mean adjacent or adjoining, but is not limited to direct contact.

Figure 2:
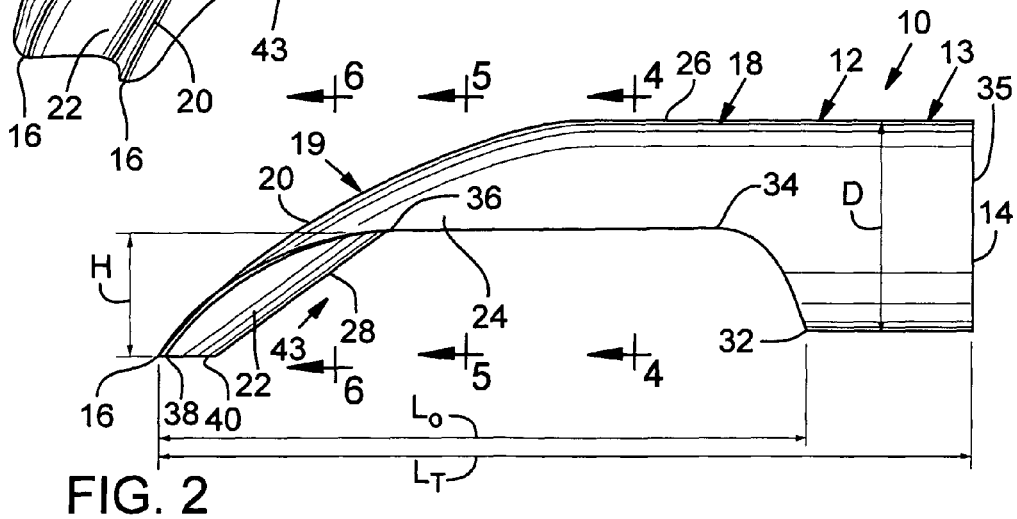
FIG. 2 is a side elevational view of the device of FIG. 1*a*.

The exhaust dispersion opening 43 can face in a generally downward direction and can have a side-view profile defining one of many shapes. Preferably, the exhaust dispersion opening 43 is symmetrical with respect to at least one symmetry plane. For example, in the illustrated embodiments, the opening 43 has a symmetry plane extending parallel to and through axis A. For example, as best shown in FIG. 2, exhaust dispersion opening 43 has a generally elongate arcuate-shaped, or elongate inverted U-shaped, side profile. The symmetrical edges defining the exhaust dispersion opening 43 can extend upwardly at an angle relative to axis A from a first location 32 proximate a lowermost surface of the neck portion 26 toward a second location 34 away from the first location 32 moving in the exhaust flow direction.

The edges then extend approximately parallel to axis A and along a lower boundary of the neck portion 26 and the flared side portions 24 in the exhaust flow direction from the second location 34 to a third location 36. Preferably, the junction between the angled edges extending from the first location 32 to the second location 34 and the edges extending from the second location 34 and the third location 36 is radiused to reduce stress and help prevent stress fractures from occurring in the tailpipe.

From the third location 36, the edges angle downwardly relative to axis A moving in the exhaust flow direction to a fourth location 38 proximate the second end 16 of the tailpipe 12. At least a portion of the edges extending from the third location 36 to the fourth location 38 adjoins a respective exhaust flow guide 20. As shown in the illustrated embodiments, at the approximate intersection between angled edges of the opening 43 and edges of the opening 43 extending generally parallel to axis A, the edges can be radiused or curved.

In some embodiments, each of the two generally symmetrical edges extending approximately parallel to axis A between the second and third locations 34, 36 comprises a substantial portion of the perimeter of the opening 43, i.e., each edge has a length of at least approximately 15% of the total length $L_O$ of the opening 43. The total length $L_O$ of the opening 43 can be defined as the distance between the first location 32 and the fourth location 38 extending axially along the opening 43. In some specific implementations, each edge extending from the second location 34 to the third location 36 can have a length of at least approximately 50% of the total length $L_O$ of the opening 43.

Although in the preferred embodiments, the exhaust outlet opening of the exhaust dilution and dispersion device described herein, e.g., opening 43 of tailpipe 12, is symmetrical, i.e., has at least one symmetrical plane, it is recognized that in some embodiments, the exhaust outlet opening is not symmetrical, i.e., does not have a plane of symmetry.

The edges of the flow guides 20 and the flow guide divider 22 at the second end 16 of the tailpipe 12 can, for example, define a lower edge 40 of the second end (see FIG. 2). In the preferred embodiments, the flow guides 20 and flow guide divider 22 extend downwardly a distance such that the lower edge 40 of the second end 16 is lower than the first location 32, e.g., the lowermost surface of the neck portion 26. In one specific implementation, the lower edge 40 of the second end 16 extends lower than the lowermost surface of the neck portion a distance equal to approximately 10% of the interior diameter of the neck portion. In some implementations, the lower edge 40 of the second end 16 of the tailpipe 12 is generally horizontally disposed, e.g., parallel to axis A.

In some implementations, the second and third locations 34, 36, respectively, are at an elevation approximately equal to the elevation of axis A. Accordingly, in this example, the edges defining the exhaust dispersion opening 43 between the second and third locations 34, 36 can extend at an elevation approximately equal to the elevation of the axis A. In other words, the height H of the opening 43 can be approximately equal to half the diameter D of the inlet portion 13 (see FIG. 2). The height H of the opening 43 can be defined as the vertical distance between the lower of the first location 32 and the fourth location 38, and the higher of the second location 34 and the third location 36.

In certain implementations, the edges defining the exhaust dispersion opening 43 extend to an elevation below the elevation of axis A. For example, the height H of the opening 43 can be less than half of the diameter D of the inlet portion. Preferably, the height H is at least approximately 25% of the diameter D. In certain other implementations, the edges defining the exhaust dispersion opening 43 extend to an elevation above the elevation of axis A. For example, the height H of the opening 43 can be more than half of the diameter D of the inlet portion 13. Preferably, the height H of the opening 43 is not more than 75% of the diameter D of the inlet portion.

In some implementations, the length $L_O$ of the opening 43 can be at least approximately 1.5 times the height H of the opening. In one specific exemplary implementation, the length $L_O$ of the opening 43 can be approximately five times the height H of the opening.

Although preferably a significant portion of the edges of the tailpipe 12 defining the exhaust dispersion opening 43 extends approximately parallel to axis A, it is recognized that in some embodiments, a significant portion of the edges need not be parallel to the axis A. For example, the exhaust dispersion opening 43 can have, among other shapes, a generally inverted V-shaped or semi-circular shaped profile.

Figure 8:
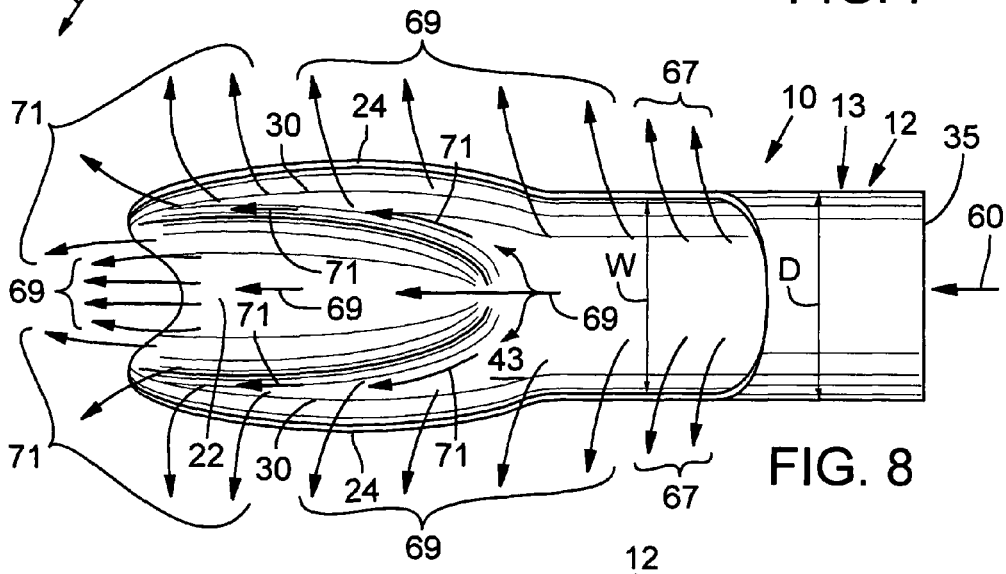
FIG. 8 is a bottom plan view of the device of FIG. 1*a* shown with exhaust flow direction indicator arrows.

In some implementations, the exhaust dispersion opening 43 can have a minimum width W that is at least approximately 50% of the diameter D of the inlet portion 13 and a maximum width that can be at least approximately 100% of the diameter D (see FIG. 8). In specific implementations, the minimum width W can be approximately 75% of the diameter D of the inlet portion 13 and the maximum width can be approximately 125% of the diameter D. As shown, the width W of the opening 43 can be defined as the lateral distance between opposing sides of the tailpipe adjacent the tailpipe edges defining the opening.

In some implementations, the length $L_O$ of the exhaust dispersion opening 43 can be at least approximately 1.5 times the width W of the opening. In a specific exemplary implementation, the length $L_O$ of the opening 43 can be at least approximately 2.5 times the width W of the opening.

Figure 7:
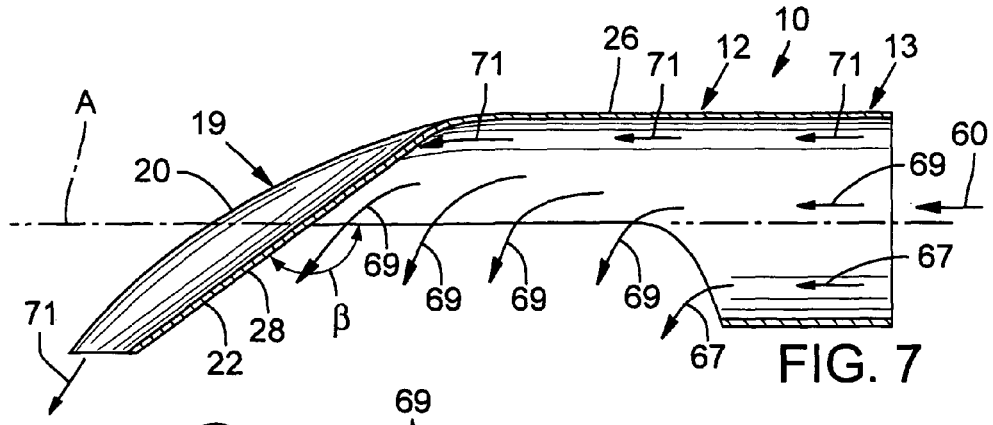
FIG. 7 is a cross sectional side view of the device of FIG. 1*a* taken along the line 7-7 of FIG. 3 with exhaust flow direction indicator arrows.
Figure 9:
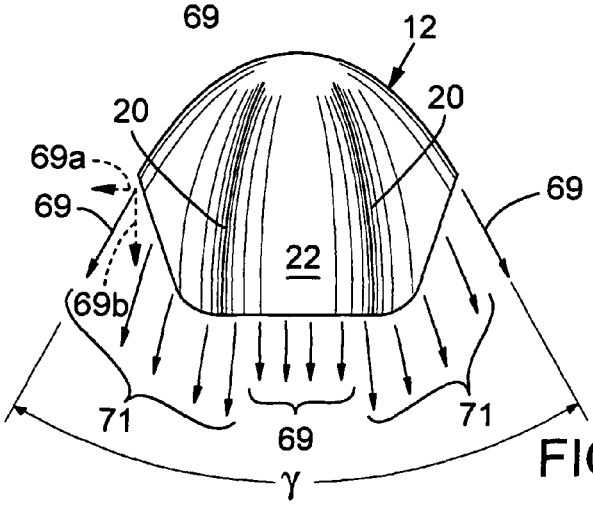
FIG. 9 is a rear view of the device of FIG. 1*a* shown with exhaust flow direction indicator arrows.

The operation of the device 10 is shown schematically in FIGS. 7-9. Exhaust, e.g., exhaust gas, from the engine, indicated generally by arrow 60, flows through the exhaust system of the vehicle or equipment and into the device 10 via the tailpipe exhaust inlet opening 35 of the tailpipe 12. Referring to FIG. 7, in general terms, the exhaust gas flowing through the tailpipe 12 can comprise lower, middle and upper portions indicated generally by directional arrows 67, 69, 71, respectively. The lower portion 67 is disposed initially at and below the upper edge defining the exhaust dispersion opening 43 between the second and third locations 34, 36, respectively, the middle portion 69 is disposed above the upper edge, and the upper portion 71 is disposed between the portion of exhaust 69 and an upper internal surface of the inlet section 13.

As the lower portion of exhaust 67 flows from the tailpipe exhaust inlet section 13 and into the tailpipe exhaust outlet section 18, it is quickly dispersed downwardly and laterally from the exhaust dispersion opening 43.

As the middle portion of exhaust 69 flows into the tailpipe exhaust outlet section 18 from the inlet section 13, some of the exhaust is quickly dispersed through the exhaust dispersion opening 43. The remaining exhaust of the portion of exhaust 69 continues to flow above the exhaust dispersion opening 43, while being incrementally expelled through the exhaust dispersion opening along the axial length of the neck portion 26 and flare-out side portions 24. Some of the middle portion of exhaust 69 flows through the exhaust outlet section 18 until it is redirected by the convex surface of the flow guide divider 22. The flow guide divider 22 redirects some of the portion of exhaust 69 downwardly and at an angle with respect to axis A, and some of the portion of exhaust 69 downwardly and laterally.

Referring to FIG. 9, the direction of exhaust flow, e.g., exhaust flow 69, is defined herein as a vector having a lateral component and a downward component. The lateral components, e.g., lateral component 69*a*, of the direction vectors of exhaust flow, e.g., exhaust flow 69, extend in a direction that is approximately perpendicular to the central axis of the tailpipe, e.g., axis A, and parallel to a ground plane that is parallel to and disposed below the exhaust dilution and dispersion device when the device is attached to a vehicle. The downward components, e.g., downward component 69*b*, of the direction vectors of exhaust flow, e.g., exhaust flow 69, extend in a direction that is approximately perpendicular to the central axis of the tailpipe and the ground plan. Accordingly, exhaust flow can be described as flowing laterally, sideways, outwardly or transversely, if the direction vector of the exhaust flow has a lateral component that is greater than zero. Similarly, exhaust flow can be described as flowing downwardly, if the direction vector of the exhaust flow has a downward component that is greater than zero.

The upper portion of exhaust 71 flows through the tailpipe outlet section 18 until it is guided downwardly by and at least partially within the flow guide channels 30. With the flow guide divider 22 having increasing interior surface areas and the channels having decreasing cross-sectional areas, as the upper portion of exhaust 71 flows through the channels 30, portions of the exhaust 71 are incrementally impacted by the flow guide divider to redirect these portions of the exhaust 71 flow outwardly away from divider to be expelled from exhaust dispersion opening 43 in a lateral direction. Some portions of the exhaust 71 are not impacted by the flow guide divider and continue to flow within the channels 30 until dispersed through the exhaust dispersion opening 43 at the second end 16 of the tailpipe 12.

The elongate exhaust dispersion opening 43 and the bifurcated end portion 19 of the device 10 promote a wide multi-directional dispersion of exhaust gases from the tailpipe 12 and can reduce backpressure in an exhaust system. More specifically, the generally elongate arcuate shape of the exhaust dispersion opening 43 in profile and the flow guides 20 and flow guide divider 22 facilitate a substantial portion of exhaust to be expelled laterally from the exhaust dispersion opening 43 along approximately, e.g., at least 90% of, the entire length of the exhaust dispersion opening. In some embodiments, a major portion (e.g., more than one-third) of the exhaust gases are dispersed laterally. Referring to FIG. 9, in some implementations, exhaust can be dispersed from the exhaust dispersion opening 43 in directions within a range about axis A defined by angle $\gamma$. In some implementations, the angle $\gamma$ can be approximately 180° or less. In a specific exemplary implementation, the angle $\gamma$ can be approximately 90°.

As mentioned above, the lateral dispersion of exhaust gases facilitated by the exhaust dilution and dispersion device described herein promotes rapid decentralization of the exhaust gas exiting the tailpipe, thus resulting is a quicker reduction of the temperature of dispersed exhaust at locations away from the tailpipe of the device than conventional tailpipe configurations.

Exemplary embodiments of the exhaust dilution and dispersion device were tested against conventional tailpipes know in the art to illustrate the enhanced temperature reduction characteristics of the device. The results and testing conditions of computer simulated and physical tests for a specific exemplary embodiment of the device described above, another specific exemplary embodiment of a exhaust dilution and dispersion device as will be described below, and the conventional tailpipe are shown in FIGS. 12*a*-12*b*. FIG. 12*a* shows the results of tests using a computational fluid dynamics (CFD) approach to simulate the exhaust temperatures under the same testing conditions at various planes away from the exhaust outlets of the exemplary devices and conventional tailpipe. FIG. 12*b* shows the results of tests using a thermocoupled plate to physically measure the actual exhaust temperature at various planes away from the exhaust outlets. FIG. 12*c* shows the results of tests using a CFD approach to simulate the exhaust temperatures under the approximately same testing conditions as in the physical tests for validating the results of the CFD models being tested.

In all the tests, the exhaust dilution and dispersion devices and conventional tailpipe were tested in an actual or simulated environment with no wind and during active regeneration of the turbo-diesel engine to which the devices and tailpipe were coupled. Other testing conditions, including the specifications of the device being tested, are indicated in FIGS. 12*a*-12*c* with respect to the particular device or tailpipe being tested and will be described in more detail below.

Figure 10:
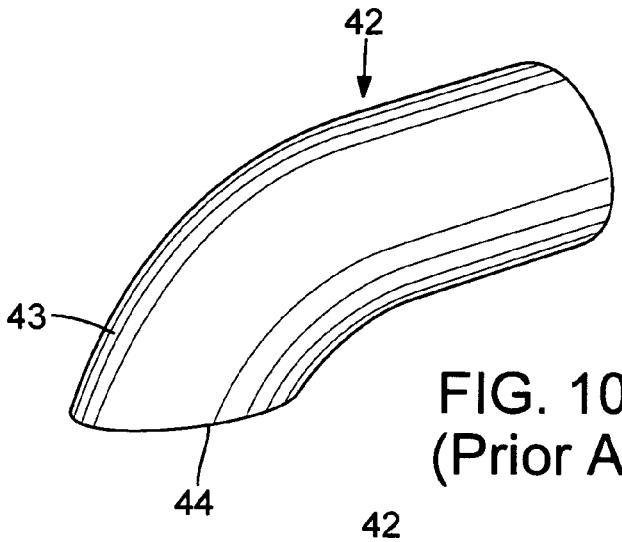
FIG. 10 (Prior Art)
FIG. 10 is a perspective view of a known exhaust tailpipe having a downwardly curved outlet.
Figure 11:
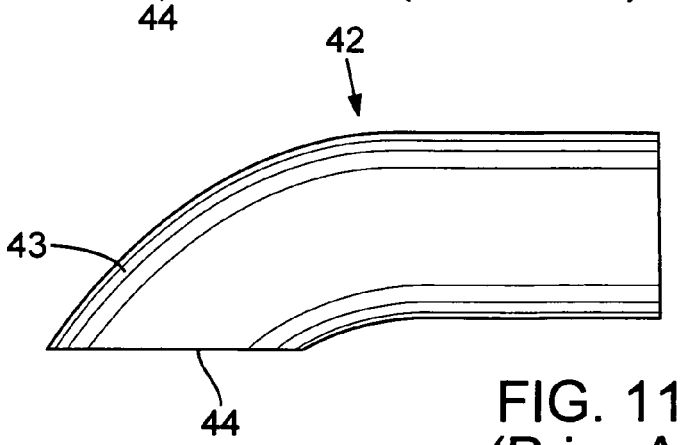
FIG. 11 (Prior Art)
FIG. 11 is a side elevational view of the tailpipe of FIG. 10.

Referring to FIGS. 12*a*-12*c*, the exhaust temperature reducing performance of Device I, i.e., a very specific exemplary implementation of device 10 shown in FIGS. 1-9, was tested against the exhaust temperature reducing performance of a conventional tailpipe, such as tailpipe 42 illustrated in FIGS. 10 and 11.

Device I had an overall length of approximately 17 inches with the tailpipe exhaust inlet section 13 having a pipe diameter of approximately five inches. In this example, the lower edge 40 of the second end 16 of Device I extended about one-half inch below the lowermost surface of the exhaust inlet section 13. The angle $\beta$ of the guide flow divider 22 with respect to axis A was approximately 143°. Device I was made from, or simulated to be made from, 439 aluminized stainless steel.

The conventional tailpipe being tested consisted of a length of circular pipe having a diameter of approximately 5 inches and a downwardly directed end portion 44 with a circular exhaust outlet 46. The conventional tailpipe had an overall length of approximately 13 inches and was made from A787 aluminized steel.

FIG. 12*a* shows the testing conditions of a first set of tests run on the simulated model of Device I and the simulated model of the conventional tailpipe. The inlet temperature of the exhaust entering the Device I and tailpipe was set at 650° C., the exhaust flow velocity through the Device I and tailpipe was set at 70 m/s and the ambient air temperature was set at 25° C.

Figure 13B:
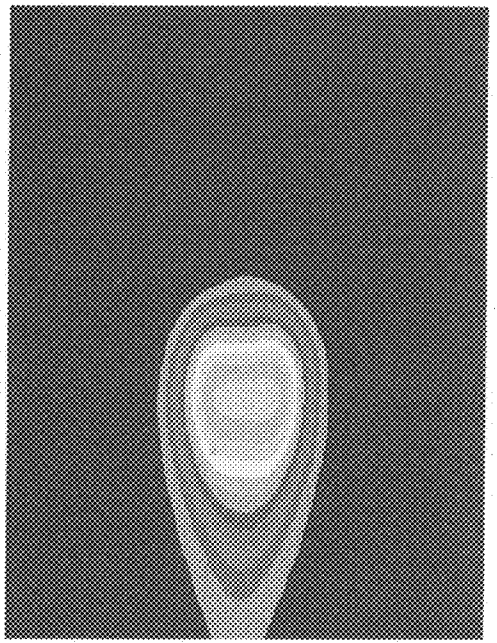
FIGS. 13*a* and 13*b* are color-coded simulated thermal plots for the exhaust dilution and dispersion device of FIG. 1*a* and the conventional tailpipe of FIG. 10, respectively, at a distance of 5.5 inches away from the outlets of the respective device and tailpipe.
Figure 13A:
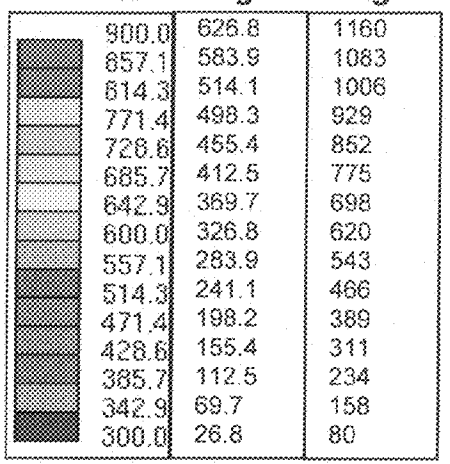

The graphical results of the tests run on the simulated model of Device I and conventional tailpipe, in the form of color-coded thermal plots of the exhaust temperatures at a horizontal plane located 5.5 inches (140 mm) away from, i.e., below, the lowermost point of the outlets of Device I and tailpipe, are shown in FIGS. 13*a* and 13*b*, respectively. As shown, and reported in FIG. 12*a*, the exhaust being expelled from Device I (see FIG. 13*a*) is more widely dispersed than the exhaust being expelled from the conventional tailpipe (see FIG. 13*b*). This wider dispersion of exhaust resulted in a maximum temperature of the exhaust at the 5.5 inch plane of approximately 305° C. In contrast, the exhaust dispersion of the conventional tailpipe was more concentrated, which resulted in a maximum temperature of the exhaust at the 5.5-inch plane of approximately 525° C. Accordingly, Device I produced a maximum exhaust temperature that was approximately 42% lower than the maximum exhaust temperature produced by the conventional tailpipe under the same conditions. Further, Device I facilitated an approximately 53% reduction of the exhaust temperature from the exhaust inlet to the 5.5-inch plane where the conventional tailpipe produced only a 19% reduction in temperature.

Figure 14B:
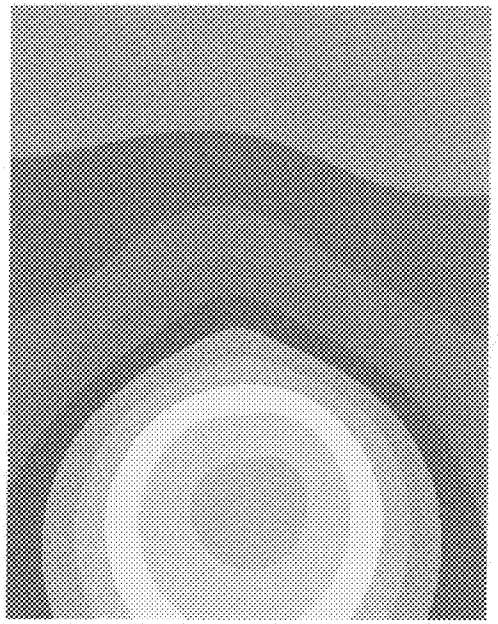
FIGS. 14*a* and 14*b* are color-coded simulated thermal plots for the exhaust dilution and dispersion device of FIG. 1*a* and the conventional tailpipe of FIG. 10, respectively, at a distance of approximately 12 inches away from the outlets of the respective device and tailpipe.
Figure 14A:
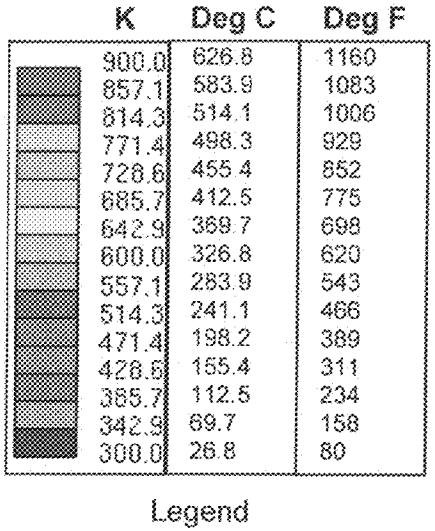

FIGS. 14*a* and 14*b* show thermal plots of the exhaust temperatures for the simulated Device I and conventional tailpipe obtained during the same tests as performed above, but at a horizontal plane located 11.8 inches (300 mm) below the lowermost point of the outlets. As shown, and reported in FIG. 12*a*, the maximum temperature of the exhaust expelled from Device I at the 11.8-inch plane was approximately 233° C. (see FIG. 14*a*), while the maximum temperature of the exhaust expelled from the conventional tailpipe at the same plane was approximately 467° C. (see FIG. 14*b*). In other words, at the 11.8-plane, the wider dispersion of exhaust produced by Device I resulted in a maximum exhaust temperature that was approximately 50% lower than the maximum exhaust temperature produced by the conventional tailpipe under the same conditions. Further, Device I facilitated an approximately 64% reduction of the exhaust temperature from the exhaust inlet to the 11.8-inch plane where the conventional tailpipe produce only a 38% reduction in temperature.

As can be recognized from the numerical results of the simulated tests in FIG. 12*a* and the graphical results shown in FIGS. 13*a*, 13*b*, 14*a*, 14*b*, wide multi-directional dispersion of exhaust gas produced by a exhaust dilution and dispersion device having an elongate exhaust dispersion opening and bifurcated end portion as described in relation to FIGS. 1-9, results in a significant drop in the maximum temperature of the exhaust at a distance away from the device when compared with the maximum temperature of the exhaust at the same distance away from conventional tailpipes.

FIG. 12*b* shows the testing conditions, including the final results, of tests conducted on physical implementations approximating Device I and the conventional tailpipe described above. The actual inlet temperature of the exhaust entering the Device I and tailpipe was approximately 550° C. and 600° C., respectively, the actual exhaust flow velocity through the Device I and tailpipe was approximately 18 m/s and the actual ambient air temperature was approximately 10° C.

Figure 15B:
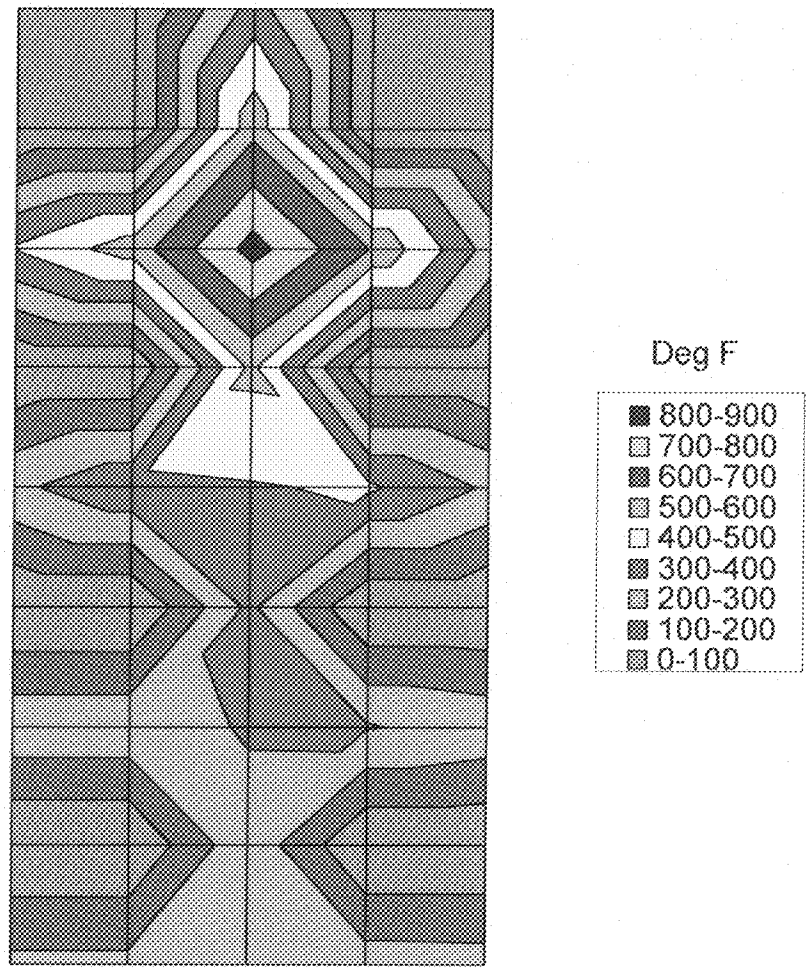
FIGS. 15*a* and 15*b* are color-coded measured thermal plots for the exhaust dilution and dispersion device of FIG. 1*a* and the conventional tailpipe of FIG. 10, respectively, at a distance of approximately 6 inches away from the outlets of the respective device and tailpipe.
Figure 15A:
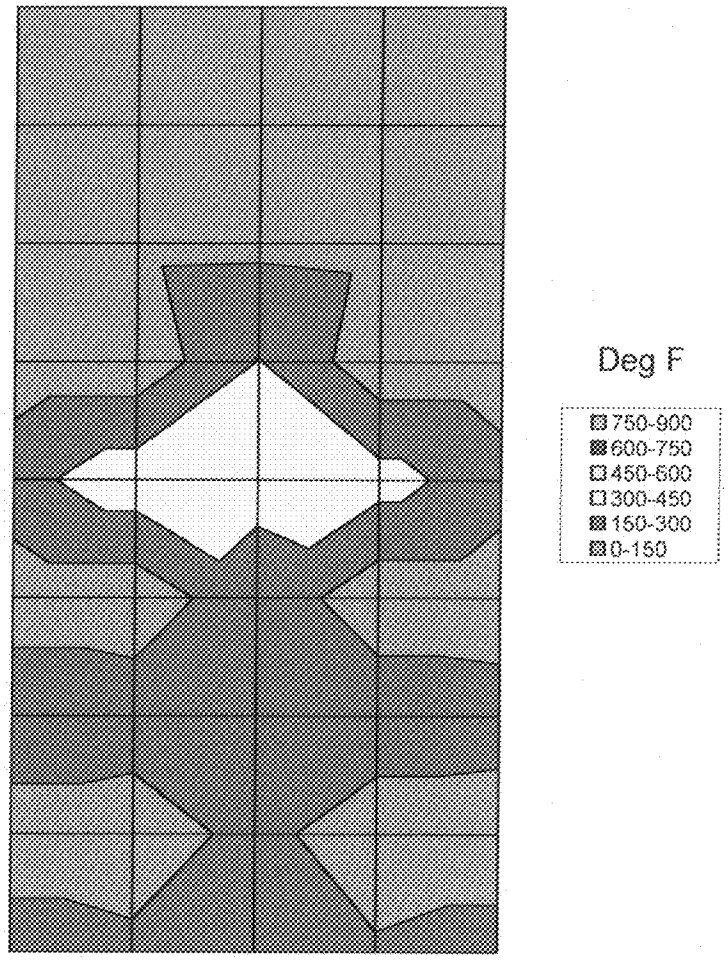

The graphical results of the tests conducted on the physical implementations of Device I and conventional tailpipe, in the form of color-coded thermal plots of the measured exhaust temperatures at a horizontal plane located 6 inches below the outlets of the Device I and tailpipe are shown in FIGS. 15*a* and 15*b*, respectively. As shown, and reported in FIG. 12*b*, the actual maximum temperature of the exhaust expelled from Device I at the 6-inch plane was measured at approximately 198° C. (388° F.) (see FIG. 15*a*), while the actual maximum temperature of the exhaust expelled from the conventional tailpipe at the 6-inch plane was measured at approximately 430° C. (806° F.) (see FIG. 15*b*). Accordingly, the physical implementation of Device I produced a maximum exhaust temperature that was 54% lower than the maximum exhaust temperature produced by the conventional tailpipe at the same plane under similar conditions. Further, the physical implementation of Device I facilitated an approximately 64% reduction of the exhaust temperature from the exhaust inlet to the 6-inch plane where the conventional tailpipe produce only a 28% reduction in temperature.

Figure 16B:
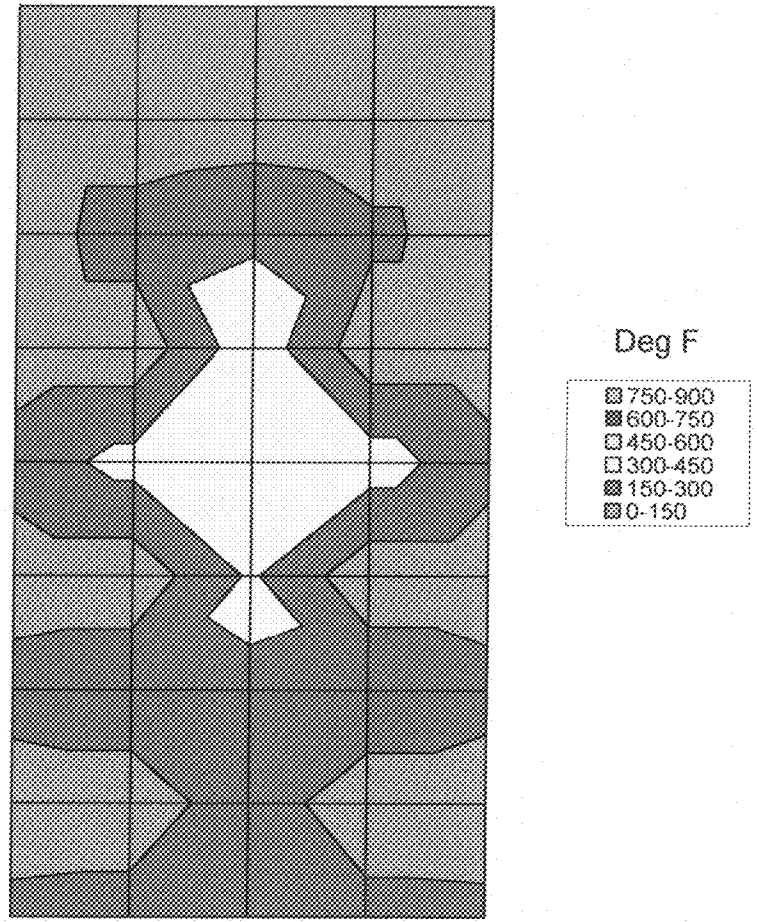
FIGS. 16*a* and 16*b* are color-coded measured thermal plots for the exhaust dilution and dispersion device of FIG. 1*a* and the conventional tailpipe of FIG. 10, respectively, at ground level, or at distance of approximately 16 inches away from the outlets of the respective device and tailpipe.
Figure 16A:
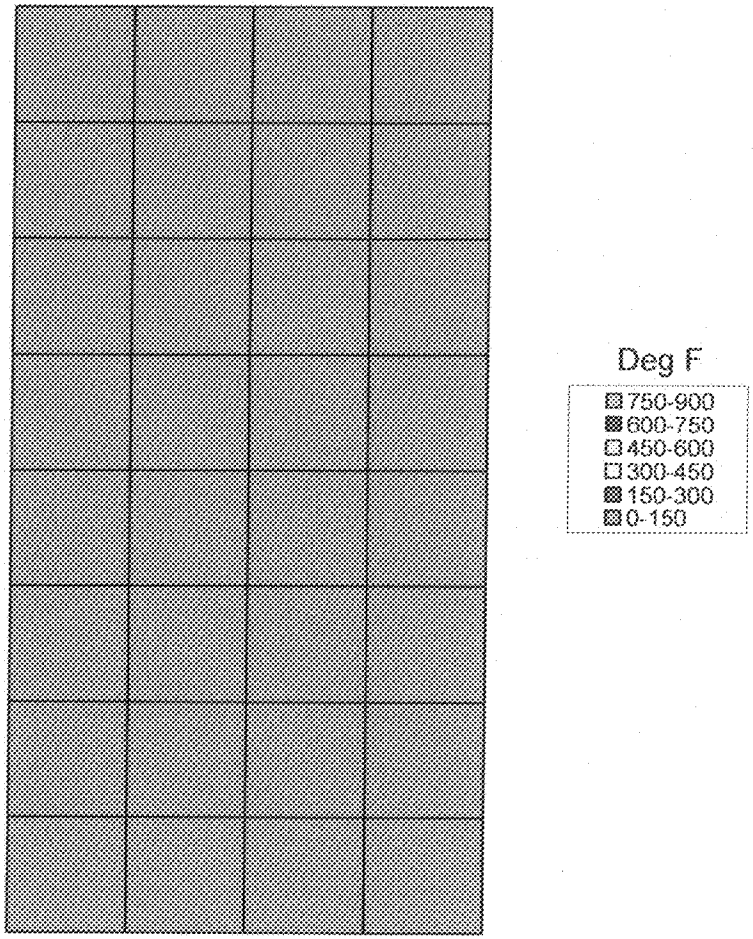

FIGS. 16*a* and 16*b* show thermal plots of the exhaust temperatures for the physical implementation of Device I similar to FIGS. 15*a* and 15*b*, respectively, but measured at a ground plane, e.g., a horizontal plane located approximately 16 inches below the lowermost point of the outlets. As shown and reported in FIG. 12*b*, the maximum temperature of the exhaust expelled from the physical Device I at the 16-inch plane was measured at approximately 42° C. (108° F.), while the maximum temperature of the exhaust expelled from the conventional tailpipe at the same plane was approximately 203° C. (397° F.). Accordingly, at the 16-inch plane, the physical implementation of Device I produced an approximately 79% greater reduction in the maximum exhaust temperature compared to the physical implementation of the conventional tailpipe. Further, Device I facilitated an approximately 92% reduction of the exhaust temperature from the exhaust inlet to the 16-inch plane where the conventional tailpipe produce only a 66% reduction in temperature.

A second set of tests using a CFD approach were run on a simulated model of Device I designed to have the same characteristics as the physical implementation of Device I used in the physical testing described above. The CFD tests were modeled to simulate the actual testing conditions found in the physical tests. The results of the second set of tests could then be compared to the measured results to validate the accuracy of the simulated models described above in relation to FIGS. 13*a* and 14*a*.

Figure 17B:
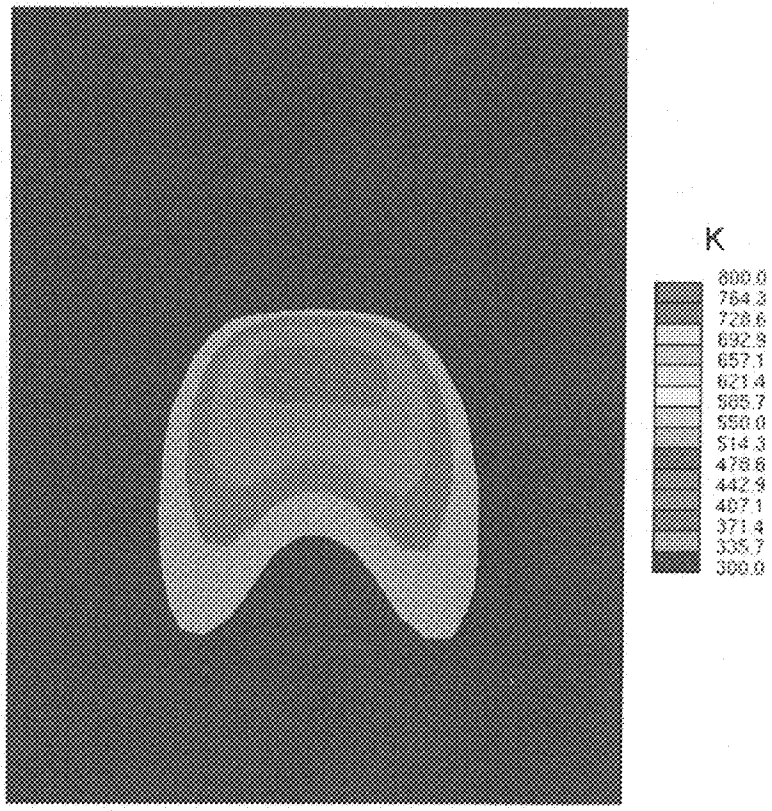
FIGS. 17*a* and 17*b* are color-coded predicted thermal plots for the exhaust dilution and dispersion device of FIG. 1*a* at approximately 6 inches away from the outlet of the device and at ground level, or approximately 16 inches away from the outlet of the device, respectively.
Figure 17A:
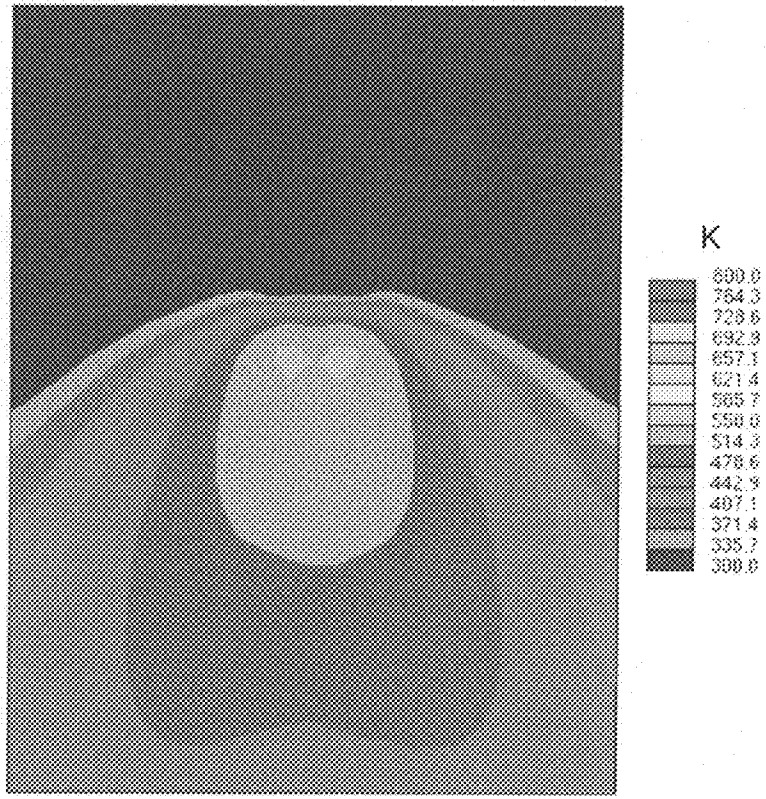

FIG. 12*c* shows the testing conditions, including the final results, and FIGS. 17*a* and 17*b* show the results graphically in the form of color-coded thermal plots for the second set of tests using the CFD approach. Referring to FIGS. 12*c*, 17*a*, and 17*b*, the maximum simulated exhaust temperature in the second set of tests for Device I was approximately 258° C. (531 K) at the 6-inch plane (see FIG. 17*a*) and approximately 155° C. (428 K) at the 16-inch plane (see FIG. 17*b*). Comparing these results with the actual measured temperatures, the simulated maximum exhaust temperatures were approximately 23% higher at the 6-inch plane (an approximately 53% reduction versus the inlet exhaust temperature) and 73% higher at the 16-inch plane (an approximately 72% reduction versus the inlet exhaust temperature) than the actual measured exhaust temperatures. Accordingly, the simulated numerical results in FIG. 12*a* and graphical results in FIGS. 13*a* and 14*a* are validated as conservative estimates of the actual performance of Device I.

Figure 18:
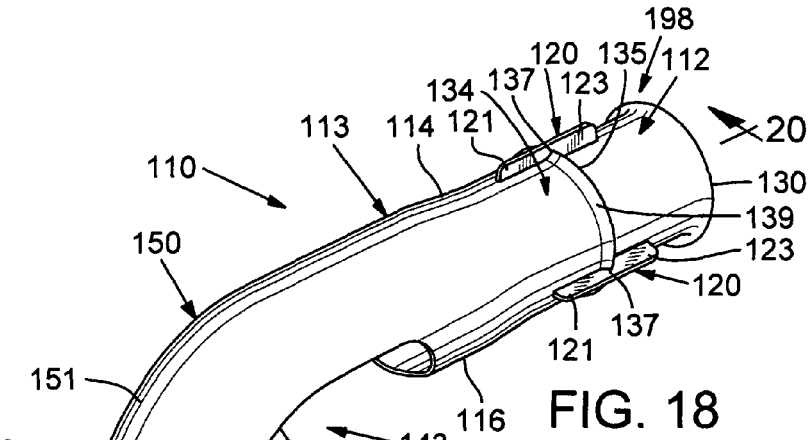
FIG. 18 is a perspective view of an exemplary embodiment of an exhaust dilution and dispersion device for an exhaust system of a vehicle having an elongate exhaust dispersion opening and an air entrainment mechanism.

Referring now to FIGS. 18-22, another exemplary embodiment of an exhaust dilution and dispersion device for reducing the maximum temperature of exhaust gas dispersed from the device is shown. Referring to FIG. 18, exemplary exhaust dilution and dispersion device 110 comprises a tailpipe, or tailpipe portion, 113 that can be coupled to a vehicle's engine exhaust system to receive exhaust gas from the engine.

As described above in relation to FIGS. 1-9, the device 110 can be coupled to an exhaust system of a vehicle or piece of equipment at any of various locations within or along the exhaust system. The device 110 can also be mounted to a vehicle or piece of equipment in a variety of orientations as described above.

The tailpipe 113 comprises an exhaust inlet section, or portion, 134 extending from a first end 193 in exhaust receiving communication with an exhaust outlet section, or portion, 150 extending from a second end 195 opposite the first end.

The inlet section 134 includes a generally circular inlet opening 135 at the first end of the tailpipe 113. In one exemplary implementation, the inlet portion 134 comprises a flared portion 139 coextensive with the inlet opening 135. Extending in a downstream, or exhaust flow, direction, i.e., from the first end 193 towards the second end 195, the inlet section 134 includes a diffusion section 114 and a mixing section 116.

The outlet section 150 includes an exhaust deflection portion 151 and an exhaust dispersion opening 143. Preferably, at least a portion of the exhaust dispersion opening 143 is coextensive with the exhaust deflection portion 151. The deflection portion 151 can be downwardly directed at an angle θ with respect to a central axis B of the tailpipe 113. More specifically, the angle θ of the outlet section 150 can be described generally as the angle defined between a line, such as line 191, that is approximately tangential to the outer surface of the outlet section 150 and the central axis B (see FIG. 20).

Desirably, inlet portion 134 and the outlet section 150 are seamlessly connected to form a monolithic one-piece construction. However, in some implementations, one or more sections of the inlet and outlet sections 134, 150, respectively, comprise respective individual sections, such as lengths of tubing coupled together such as by welding.

Figure 19:
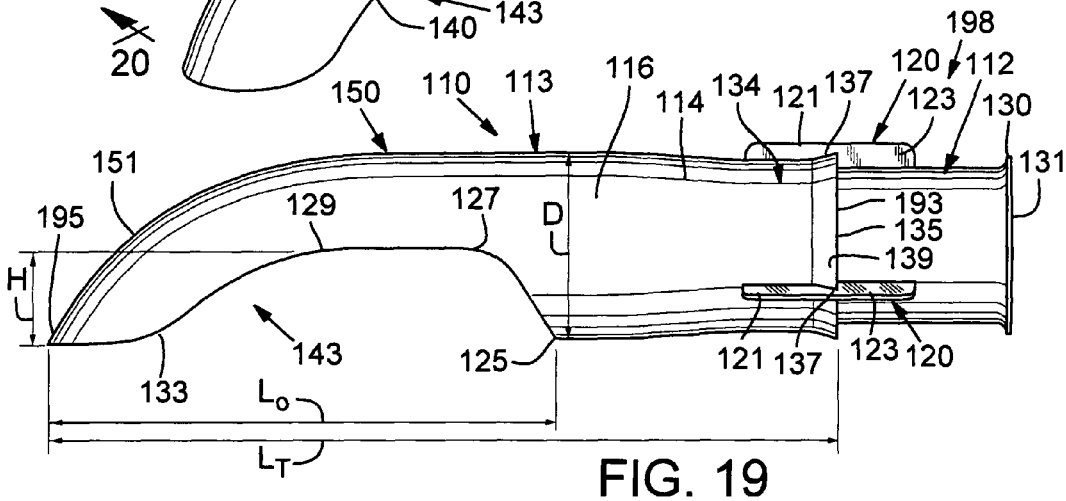
FIG. 19 is a side elevational view of the device of FIG. 18.

As shown in FIG. 19, the exhaust dispersion opening 143 has a generally elongate shape that faces in a generally downward direction. The exhaust dispersion opening 143 can extend longitudinally from the upstream boundary or end of the outlet section 150.

The exhaust dispersion opening 143 can have one of many alternative shapes. However, in a desirable form, a portion of the exhaust dispersion opening 143 has a generally elongate arcuate-shape, or elongate inverted U-shaped, side profile. For example, referring to FIG. 16, opposing generally symmetrical edges of the tailpipe 113 defining the illustrated exhaust dispersion opening 143 extend in the downstream direction upwardly at an angle relative to axis B from a first location 125 proximate a lower surface of the outlet section 150 toward a second location 127 away from the lower surface of the outlet section. The symmetrical edges then extend approximately parallel to axis B in the downstream direction from the second location 127 to a third location 129. From the third location 129, the edges curve downwardly at an angle relative to axis B toward end portion 195 from the third location 129 to a fourth location 133. From the fourth location 133, the edges are adjoined at the second end 195 of the tailpipe 113.

In some embodiments, each of the two generally symmetrical edges extending approximately parallel to axis B between the second and third locations 127, 129 comprises a substantial portion of the perimeter of the opening 143, i.e., each edge has a length of at least approximately 15% of the total length $L_O$ of the opening 143. In specific implementations, each edge between the second and third locations 127, 129 can have a length of at least approximately 25% of the total length $L_O$ of the opening 143. The total length $L_O$ of the opening 43 can be defined as the distance extending axially along the opening 143 between the first location 125 and the end of the opening proximate the end 195 of the tailpipe 113.

In some implementations, the second and third locations 127, 129, respectively, are at an elevation approximately equal to the elevation of axis B. Accordingly, in this example, the edges defining the exhaust dispersion opening 143 between the second and third locations 127, 129 can extend at an elevation approximately equal to the elevation of the axis B. In other words, the exhaust dispersion opening 143 can have a height H approximately equal to half a major diameter D of the tailpipe 113, for example, the diameter D of the mixing section 116 (see FIG. 19).

In certain implementations, the edges of the tailpipe 113 defining the exhaust dispersion opening 143 extend to an elevation below the elevation of axis B. For example, the height H of the opening 143 can be less than half of the diameter D of the tailpipe 113. Preferably, the height H is at least approximately 25% of the diameter D.

In certain other implementations, the edges of the exhaust dispersion opening 143 extend to an elevation above the elevation of axis B. For example, the height H of the opening 143 can be more than half of the diameter D of the tailpipe 113. Preferably, the height H of the opening 143 is not more than 75% of the diameter D of the tailpipe.

In some implementations, the length $L_O$ of the opening 143 can be at least approximately 1.5 times the height H of the opening. In one specific exemplary implementation, the length $L_O$ of the opening 143 can be approximately five times the height H of the opening.

Figure 22:
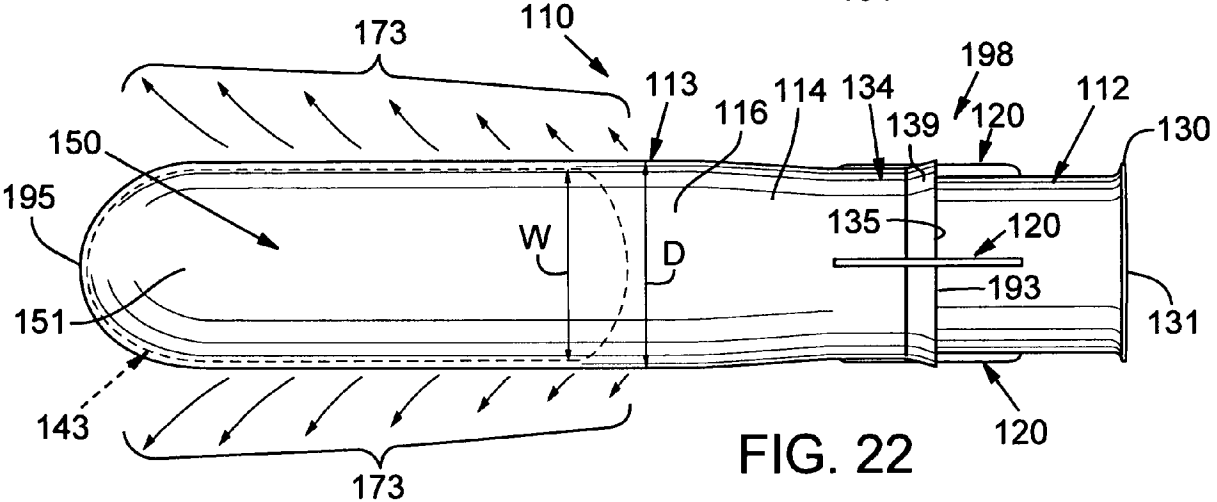
FIG. 22 is a top view of the device of FIG. 18 shown with exhaust flow direction indicator arrows.

In some implementations, the exhaust dispersion opening 143 can have a width W that is at least approximately 75% of the diameter D of the tailpipe 113 (see FIG. 22). In specific implementations, the width W can be at least approximately 100% of the diameter D of the tailpipe 113.

In some implementations, the length $L_O$ of the exhaust dispersion opening 143 can be at least approximately 1.5 times the width W of the opening. In a specific exemplary implementation, the length $L_O$ of the opening 143 can be at least approximately 2.5 times the width W of the opening.

Although preferably a significant portion of the edges defining the exhaust dispersion opening 143 extend approximately parallel to the axis B, it is recognized that in some embodiments, a significant portion of the edges defining the opening need not be parallel to the axis B. For example, the exhaust dispersion opening 143 can have, among other shapes, a generally inverted V-shaped or semi-circular shaped profile.

Referring again to FIG. 20, the diffusion section 114 of the inlet section 134 of the tailpipe 113 can have, for example, a generally frusto-conical shape defining a passageway with a diverging sidewall moving in the downstream direction, i.e., from right to left in FIG. 20. In other words, the diffusion section passageway desirably expands such that the area of the passageway increases along its axial length when moving in the downstream direction. In some embodiments, the diverging sidewall extends at an angle of between approximately 5° and 15° relative to axis B. In specific embodiments, the angle is approximately 10° relative to axis B.

The mixing section 116 can have a generally cylindrical shape and define a passageway having a sidewall extending generally parallel to central axis B of the exhaust dilution and dispersion device 110. In other words, the cross-sectional area at any given location along the axial length of the mixing section 116 can be substantially the same.

Figure 20:
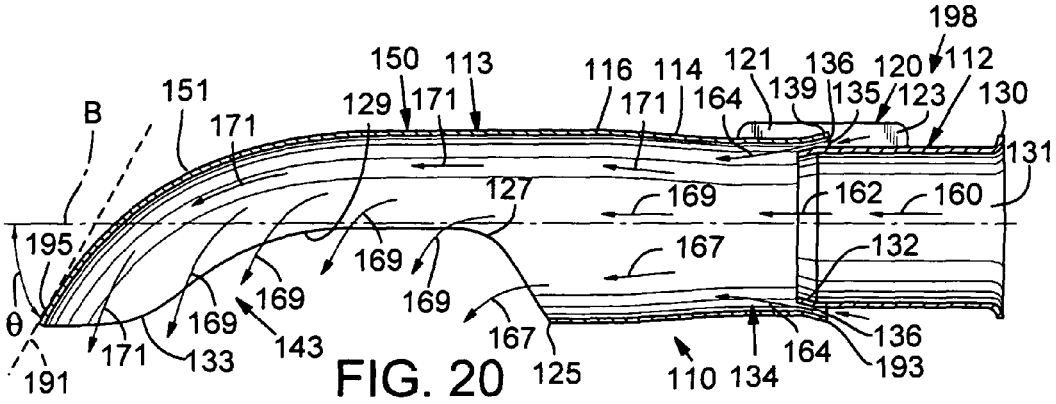
FIG. 20 is a cross-sectional side elevational view of the device of FIG. 18 taken along the line 20-20 in FIG. 18.

As shown schematically in FIG. 20, in operation, exhaust, e.g., exhaust gas, from the engine indicated by arrow 160 flows through the tailpipe 113. The exhaust first flows into the diffusion section 114. The diverging sidewall of the diffusion 114 section passageway causes the exhaust, indicated generally by arrows 167, 169, 171, to diffuse or expand as it flows through the diffusion section. Diffusion or expansion of the exhaust results in a decrease in the velocity of the exhaust, which reduces the temperature of the exhaust. From the diffusion section 114, the exhaust flows into the mixing section 116.

Figure 21:
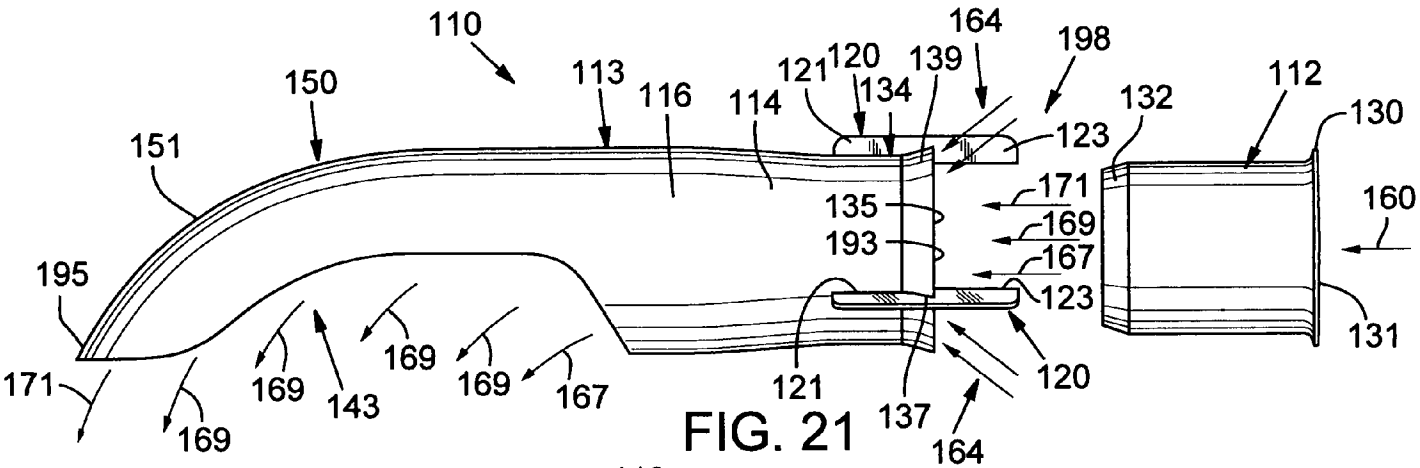
FIG. 21 is an exploded view of the device of FIG. 18 shown with the gussets removed and respective air and exhaust flow direction indicator arrows.

From the mixing section 116, the exhaust flows into the outlet portion 150 to be eventually expelled through the exhaust dispersion opening 143. Referring to FIGS. 20 and 21, upon entering the outlet portion 150, some of the exhaust, e.g., the portion of the exhaust below the upper edges defining the exhaust dispersion opening 143, e.g., the edges defining the opening that extend approximately parallel to axis B in the illustrated embodiment, pass through the exhaust dispersion opening 143 as indicated generally by directional arrow 167. Some of the exhaust, e.g., a portion of the exhaust above the upper edges of the exhaust dispersion opening 143, is not expelled upon entering the outlet portion 150, but continues to flow through the outlet portion above the exhaust dispersion opening, while being incrementally expelled through the exhaust dispersion opening along the axial length of the outlet portion as indicated generally by directional arrows 169. Yet some of the exhaust flows through the outlet portion 150 above a majority of the length $L_O$ of the exhaust dispersion opening 143 and is expelled through the opening near the end 195 of the tailpipe 113 as indicated generally by directional arrows 171.

As indicated in FIG. 22, the configuration of exhaust dispersion opening 143 facilitates lateral dispersion of exhaust indicated generally by arrows 173 from the exhaust dispersion opening along its axial length. Lateral dispersion of exhaust refers to dispersion in an outward direction away from a direction parallel to axis B. The exhaust flowing through the mixing section 116 is traveling in a direction generally parallel to axis B of the device 110. As the portion of the exhaust below the upper edges of the exhaust dispersion opening 140, e.g., the flow indicated by arrows 167 in FIGS. 20 and 21, flows into the outlet section 150 and just past the leading edge of the exhaust dispersion opening 143, it is not bounded laterally by the sidewall of the tailpipe 113 and is thus allowed to flow laterally outwardly away from the tailpipe along the axial length of the opening. Further, at least some of the mixture flowing above the upper edges of the exhaust dispersion opening 143, e.g., the flow indicated by arrows 169 in FIGS. 20 and 21, is dispersed laterally from the opening. Desirably, a major portion (e.g., more than one-third) of the exhaust gases is dispersed laterally from the exhaust dispersion opening 143.

As can be recognized, the configuration and shape of the exhaust dispersion opening 143 promotes a wide dispersion of the exhaust into the ambient air and reduces backpressure. For example, in some embodiments, exhaust can be dispersed from the exhaust dispersion opening 143 in directions within an angle range about axis B of approximately 180°. In a specific exemplary implementation, the angle range is approximately 90°.

This enhanced dispersion of the exhaust acts to dilute the heated exhaust gas concentration more quickly and effectively than a conventional tailpipe. Because the exhaust gas concentration is more widely dispersed and quickly diluted, more effective mixing of the exhaust with the ambient air upon exiting the device 110 occurs, which results in a quicker reduction of the temperature of the exhaust gases as the gases move away from the device. Consequently, the temperature of the exhaust gases at specific distances away from the exhaust dispersion opening 143 is more effectively reduced to meet or exceed industry safety standards.

Referring back to FIG. 18, to help further reduce the temperature of the exhaust received from a vehicle's exhaust system, the device 110 can comprise an ambient air entrainment system 198 to draw ambient air into the exhaust flow to cool the exhaust flow. For example, the ambient air entrainment system 198 can comprise a nozzle 112 connected to the tailpipe 113 via structural connectors, such as gussets 120.

In the illustrated exemplary implementation, the nozzle 112 comprises a length of tubular pipe having a generally circular cross-section. The nozzle 112 includes an inlet section 130 that can have an exhaust inlet opening 131 and be coupled to a portion of an exhaust system of a vehicle or equipment engine, such as to an exhaust pipe or muffler of a diesel engine for a truck, by welding or through use of fasteners or pipe couplings. The inlet section 130 can have a flared portion for convenience in coupling the nozzle 112 to the exhaust system.

Preferably, in some implementations of a device 110 having an air entrainment system 198, the opening 143 has a length $L_O$ that is at least approximately 50% of the length $L_T$ of the tailpipe 113 (see FIG. 19). In some implementations, however, it is recognized that the length $L_O$ of the opening 143 can be less than 50% of the length $L_T$ of the tailpipe 113.

Each gusset, or connector, 120, in the exemplary form shown, comprises a length of material having a generally elongate fin-like shape with a notch 137 intermediate a tailpipe mounting portion 121 and a nozzle mounting portion 123. The illustrated tailpipe mounting portion 121 has a mounting surface that is coextensive with an outer surface of the tailpipe inlet section 134 when the gusset 120 is mounted to the tailpipe. The illustrated nozzle mounting portion 123 has a mounting surface that is coextensive with an outer surface of the nozzle 113 and offset radially from, e.g., not coplanar with, the mounting surface of the tailpipe mounting portion 121 when the gusset 120 is mounted to the nozzle.

The gussets 120 couple the nozzle 112 and the tailpipe 113 together such as by welding the tailpipe mounting portions 121 of the gussets 120 to the outer surface of the tailpipe 113, welding the notches 137 of the gussets 120 to the flared portion 139 of the tailpipe inlet section 134, and welding the nozzle mounting portions 123 of the gussets 120 to the outer surface of the nozzle 112. In the illustrated embodiment, the gussets 120 extend parallel to axis B of the exhaust dilution and dispersion device 110.

Although three gussets 120 are shown in the illustrated embodiment, it is recognized that fewer or more than three gussets can be used. It is recognized that alternative coupling structures other than gussets, such as conventional fasteners can also be used.

As shown in FIG. 20, the nozzle 112 is partially disposed within the tailpipe 113. The nozzle 112 has an exhaust accelerating outlet section 132 opposite the inlet section 130. The exhaust accelerating outlet section 132 has, in this example, a generally frusto-conical shape having a sidewall that converges in the exhaust flow direction. In some embodiments, the converging sidewall of the accelerating outlet section 132 extends at an angle of between approximately 0° and 15° relative to axis B. In specific embodiments, the angle is approximately 5° relative to axis B.

The flared or enlarged inlet section 134 of the tailpipe 113, in this example, also has a generally frusto-conical shape with a side wall that converges in the exhaust flow direction. The sidewall of the enlarged inlet section 134 of the tailpipe 113 desirably defines a passageway having a reduced cross-sectional dimension, such as having circular cross-sectional areas of decreasing diameters, along its axial length moving in the exhaust flow direction.

Desirably, the smallest diameter of the tailpipe inlet section passageway is greater than the largest outer diameter of the outlet section 132 of the nozzle 112. In this way, the nozzle 112 can be insertably mounted within and coaxially with the tailpipe 113 by the gussets 120 such that an annular ambient air passageway, or opening, 136 is defined between the inner surface of the passageway of the tailpipe inlet section 134 and an outer surface of the outlet section 132 of the nozzle 112. An upstream end of the passageway 136 is in air receiving communication with ambient air (air outside of the device 110) in the environment and a downstream end of the passageway is in air expelling communication with an interior of the tailpipe 113. The air passageway, in alternative embodiments, is other than of an annular configuration.

As shown schematically in FIG. 20, in operation, exhaust from the engine flows through the exhaust system (not shown) and into the nozzle 112, as indicated by arrow 160, at a first velocity. The velocity of the exhaust remains substantially the same until the exhaust flows into the exhaust accelerating outlet section 132 of the nozzle 112, where the velocity of the exhaust increases as the exhaust flowing through the outlet section is compressed due to the converging nature of the sidewall of the outlet section. The accelerated exhaust exiting the outlet section 132 flows into the tailpipe 113, indicated generally by arrow 162, and causes a pressure differential with the surrounding ambient air. The pressure differential creates a vacuum effect to draw in ambient air, indicated generally by arrows 164, through the ambient air passageway 136. The ambient air at least partially mixes with the exhaust flowing out of the nozzle 112. The ambient air has a temperature less than the temperature of the exhaust gas and therefore acts to reduce the overall temperature of the exhaust.

Figure 23:
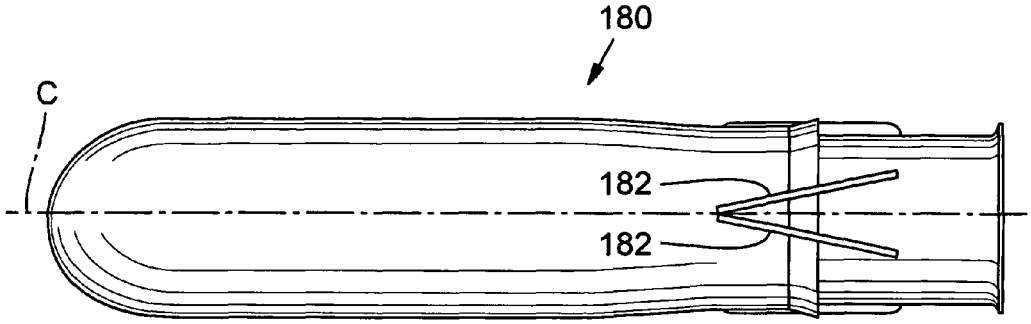
FIG. 23 is a top view of an exhaust dilution and dispersion device for an exhaust system of a vehicle having angled turbulence enhancing gussets.

In some embodiments, one or more turbulence enhancers can be utilized to promote turbulence in the exhaust and air flowing through the device, which enhances mixing of the air and exhaust. In some embodiments, the turbulence enhancers can be modified gussets, such as bent, curved or angled gussets. For example, as shown in FIG. 23, modified gussets 182 are positioned at an angle relative to, or otherwise non-parallel with, the central axis C of exhaust dilution and dispersion device 180, which can have features similar to device 110. A portion of the gussets 182 can penetrate the side wall of the tailpipe and protrude into the interior of the tailpipe downstream of the ambient air passageway and within the exhaust flow stream. The portion of the gussets 182 within the exhaust flow stream acts to obstruct the flow of exhaust and entrained air and induce turbulence in the exhaust and air flowing through the tailpipe.

In some embodiments, separate from, or in addition to modified gussets, turbulence enhancing vanes, protrusions or baffles can be mounted within the interior of the exhaust dilution and dispersion device and positioned to obstruct the exhaust and air flowing through the tailpipe.

After mixing with the ambient air drawn through the passageway 136, the exhaust and air flows into and through the diffusion and mixing sections 114, 116, respectively, and is dispersed through the exhaust dispersion opening 143 in a manner similar to that described above. More specifically, as it pertains to a tailpipe coupled to an air entrainment system for drawing in ambient air, as the exhaust and air mixture flows through the diffusion section 114, the diffusion or expansion of the mixture results in a decrease in the velocity of the mixture, which facilitates further mixing of the ambient air with the exhaust to further reduce the effective temperature of the exhaust.

The mixing section allows the exhaust and air mixture to flow at a constant velocity, which helps to stabilize the exhaust and air mixture exiting the diffusion section. Stabilization of the exhaust and air mixture can reduce negative pressure, or back pressure, within the expansion section, restrict undesirable separation of the exhaust and air mixture, and promote further mixing of the exhaust and air prior to the mixture being dispersed into the surrounding environment.

Referring back to FIGS. 12*a*-12*c*, testing similar to that performed on Device I was conducted on Device II, i.e., a very specific exemplary implementation of device 110 shown in FIG. 18-22. Device II had an overall length of approximately 30 inches and the inlet section 134 had a pipe diameter of approximately 6 inches. Device II also was made from, or simulated to be made from 439 aluminized stainless steel.

Figure 24B:
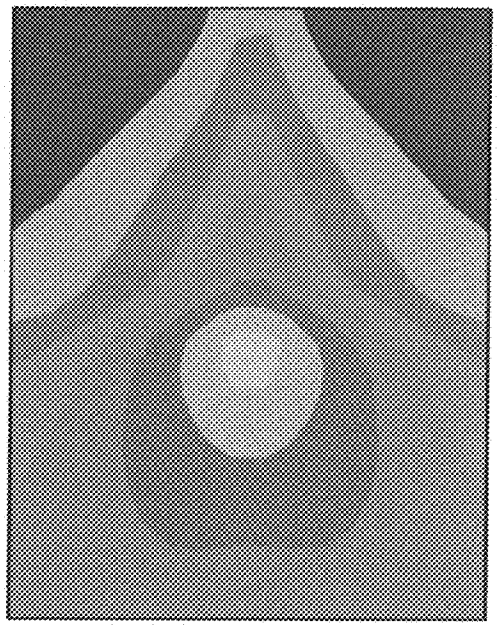
FIGS. 24*a* and 24*b* are color-coded simulated thermal plots for the exhaust dilution and dispersion device of FIG. 18 at a distance of 5.5 inches and approximately 12 inches, respectively, away from the outlet of the device.
Figure 24A:
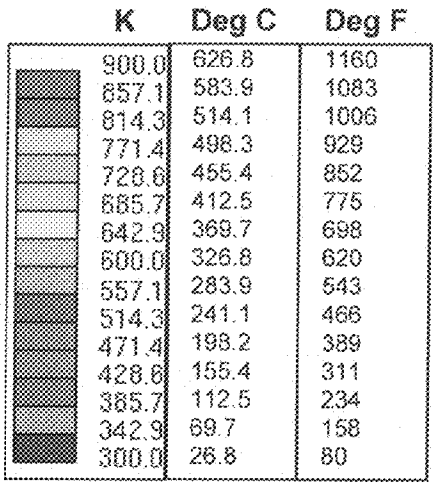
Figure 24A:
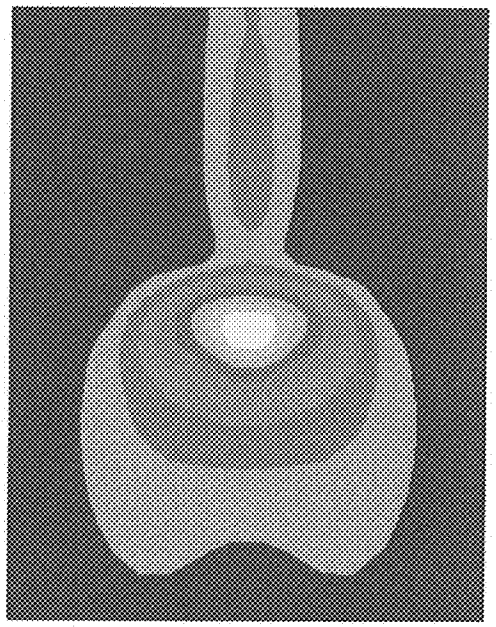

As shown in FIG. 12*a*, a simulated model of Device II was tested using the same testing conditions as was used for the first set of simulated testing of Device I. The graphical results of the first set of simulated tests of Device II in the form of color coded thermal plots of the exhaust temperatures at the 5.5-inch plane and the 11.8-inch plane are shown in FIGS. 24*a* and 24*b*, respectively. As shown in FIGS. 24*a* and 24*b*, and reported in FIG. 12*a*, the maximum temperature of the exhaust being expelled from Device II at the 5.5-inch plane and 11.8-inch plane was approximately 467° C. and 346° C., respectively. Accordingly, Device II facilitated an approximately 38% reduction and an approximately 47% reduction of the exhaust temperature from the exhaust inlet to the 5.5-inch plane and 11.8-inch plane, respectively.

When compared with the results of testing the simulated conventional tailpipe as shown in FIGS. 13*b* and 14*b*, and reported in FIG. 12*a*, a exhaust dilution and dispersion device described above in relation to FIGS. 18-22, e.g., Device II, can provide a significantly greater reduction of the temperature of the exhaust at distances away from the device outlet than conventional tailpipes. For example, Device II provided an approximately 11% and 26% greater reduction in the temperature of the exhaust at the 5.5-inch and 11.8-inch planes, respectively.

FIG. 12*b* shows the testing conditions, including the final results, of tests conducted on physical implementations approximating Device II. The actual inlet temperature of the exhaust entering the Device II was approximately 520° C., the actual exhaust flow velocity through the Device II was approximately 40 m/s and the actual ambient air temperature was approximately 18° C.

Figure 25B:
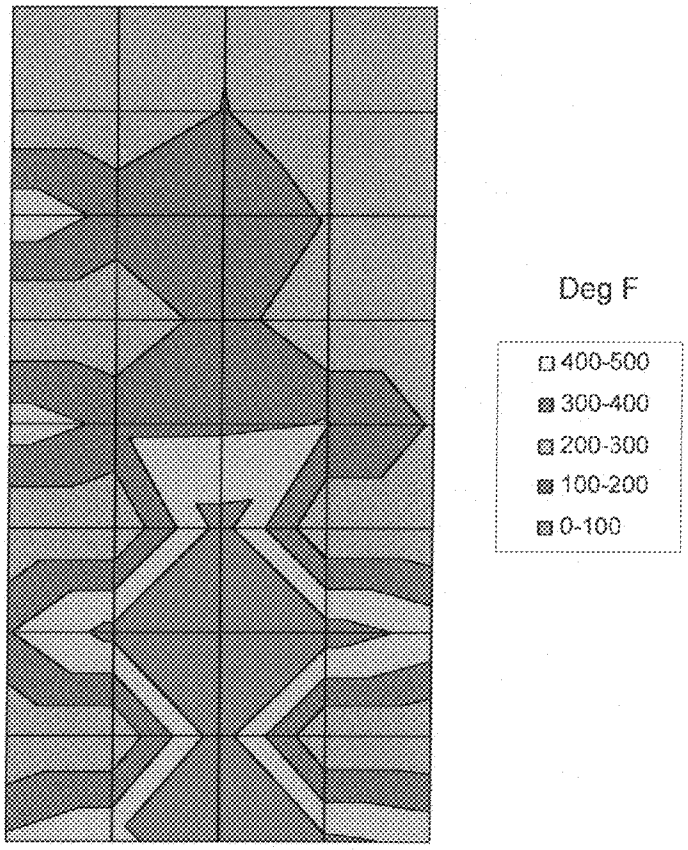
FIGS. 25*a* and 25*b* are color-coded measured thermal plots for the exhaust dilution and dispersion device of FIG. 18 at a distance of approximately 6 inches away from the outlet of the device and at ground level, or approximately 16 inches away from the outlet of the device.
Figure 25A:
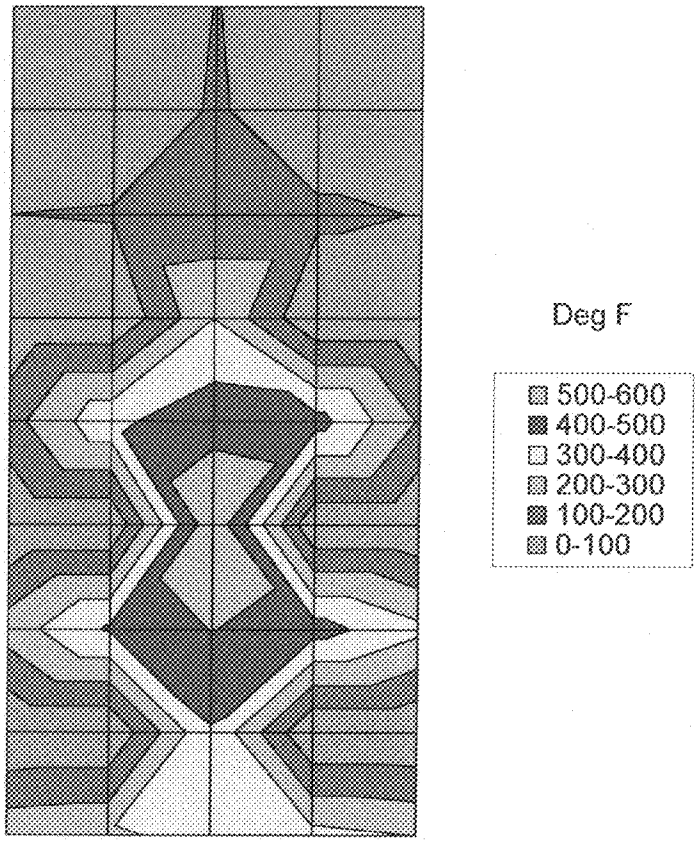

The graphical results of the tests conducted on the physical implementations of Device II in the form of color-coded thermal plots of the measured exhaust temperatures at the 6-inch plane and the 15.5-inch plane are shown in FIGS. 25*a* and 25*b*, respectively. As shown, and reported in FIG. 12*b*, the actual maximum temperature of the exhaust expelled from Device II at the 6-inch plane was measured at approximately 310° C. (590° F.) (see FIG. 25*a*) and at the 15.5-inch plane was measured at approximately 186° C. (367° F.) (see FIG. 25*b*). Accordingly, the physical implementation of Device II produced a maximum exhaust temperature that was approximately 28% and approximately 8% lower than the maximum exhaust temperature produced by the conventional tailpipe at approximately the same respective planes under similar conditions. Further, the physical implementation of Device II facilitated an approximately 40% and 64% reduction of the exhaust temperature from the exhaust inlet to the 6-inch plane and 15.5-inch plane, respectively.

A second set of tests using a CFD approach were run on a simulated model of Device II designed to have the same characteristics as the physical implementation of Device II used in the physical testing described above. The CFD tests were modeled to simulate the actual testing conditions found in the physical tests. The results of the second set of tests could then be compared to the measured results to validate the accuracy of the simulated models described above in relation to FIGS. 24*a* and 24*b*.

Figure 26B:
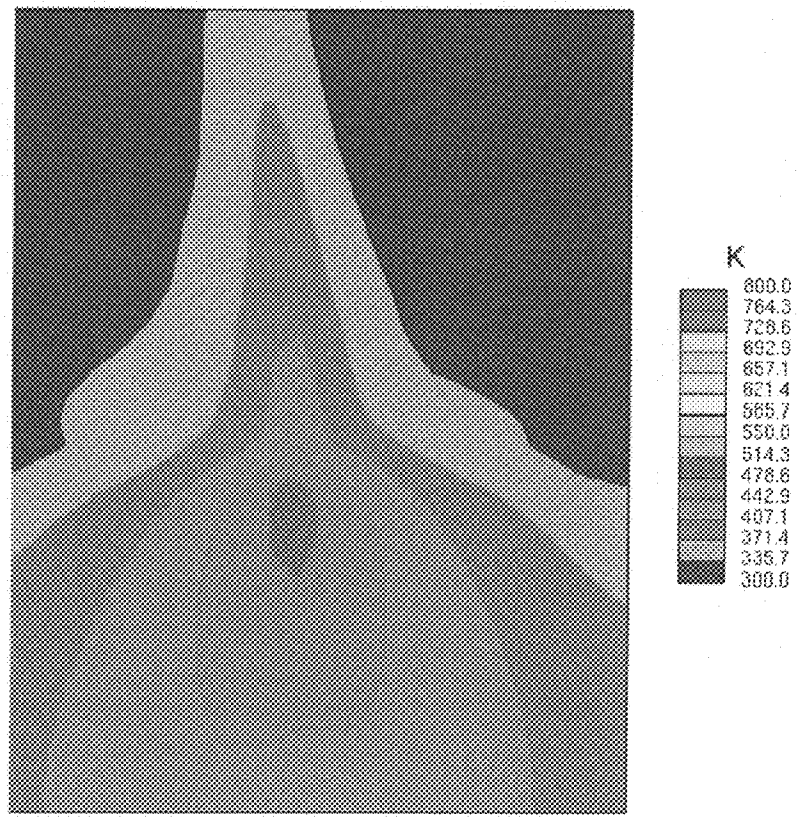
FIGS. 26*a* and 26*b* are color-coded predicted thermal plots for the exhaust dilution and dispersion device of FIG. 18 at a distance of approximately 6 inches away from the outlet of the device and at ground level, or approximately 16 inches away from the outlet of the device.
Figure 26A:
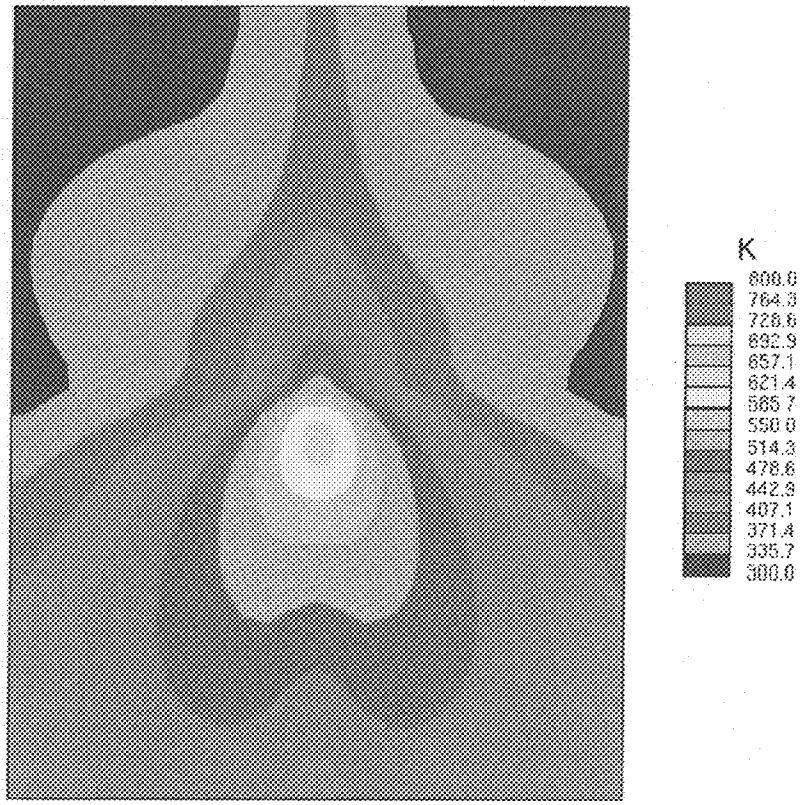

FIG. 12*c* shows the testing conditions, including the final results, and FIGS. 26*a* and 26*b* show the results graphically in the form of color-coded thermal plots for the second set of tests using the CFD approach. Referring to FIGS. 12*c*, 26*a*, and 26*b*, the maximum simulated exhaust temperature in the second set of tests for Device II was approximately 369° C. (642 K) at the 6-inch plane (see FIG. 26*a*) and approximately 242° C. (515 K) at the 16-inch plane (see FIG. 26*b*). Comparing these results with the actual measured temperatures, the simulated maximum exhaust temperatures were approximately 16% higher at the 6-inch plane (an approximately 29% reduction versus the inlet exhaust temperature) and 23% higher at the 16-inch plane (an approximately 54% reduction versus the inlet exhaust temperature) than the actual measured exhaust temperatures. Accordingly, the simulated numerical results in FIG. 12*a* and the graphical results in FIGS. 24*a* and 24*b* are validated as conservative estimates of the actual performance of Device II.

Figure 27:
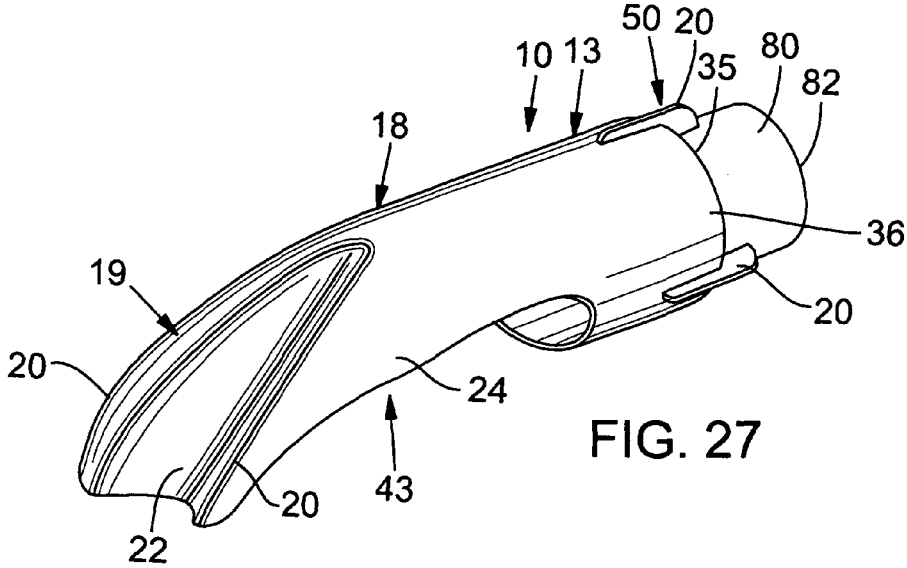
FIG. 27 is a perspective view of an exemplary embodiment of an exhaust dilution and dispersion device for an exhaust system of a vehicle having an elongate exhaust dispersion opening, bifurcated end portion and an air entrainment mechanism.

Referring to FIG. 27, according to one exemplary embodiment, exhaust dilution and dispersion device 10 can comprise an ambient air entrainment system 50 similar to that described above for exhaust dilution and dispersion device 110 of FIGS. 18-22 to enhance the temperature reducing capabilities of the device 10. Like the air entrainment system 198 of device 110, the air entrainment system 50 of the device shown in FIG. 27 comprises a nozzle 12 connected to the tailpipe 13 via structural connectors, such as gussets 20. Further, although the tailpipe 13 of device 10 does not show a diffusion section and a mixing section, such as described above in relation to the tailpipe 112 of device 110, it is recognized that in some implementations, the tailpipe 12 can have a diffusion section and a mixing section to facilitate cooling of the exhaust and/or mixing of ambient air drawn into the tailpipe via an air entrainment system 50 with exhaust flowing through the tailpipe. Also, although not specifically shown, the embodiment of device 10 shown in FIG. 27 can include turbulence enhancers, such as turbulence enhancing gussets, as described above in relation to FIG. 23.

In some embodiments of the exhaust dilution and dispersion device 10 having an ambient air entrainment system 50, the opening 43 has a length $L_O$ that is preferably at least approximately 50% of the length $L_T$ of the tailpipe 13 (see FIG. 2). In some implementations, however, it is recognized that the length $L_O$ of the opening 43 can be less than 50% of the length $L_T$ of the tailpipe 13.

The nozzle 12 can comprise a length of tubular pipe having a generally circular cross-section. Like the nozzle 112 of device 110, the nozzle 12 includes an inlet section 30 that has an exhaust inlet opening 31 and is coupled to an exhaust pipe, muffler or other portion of the exhaust system a vehicle a piece of equipment. Although not shown, the inlet section 30 can have a flared portion for convenience in coupling the nozzle 12 to the exhaust system. The nozzle 12 is partially disposed within the tailpipe by the gussets 20 and can interact with the tailpipe inlet section 13 to define an ambient air passageway or opening as described above. The flow of exhaust can create a vacuum effect to draw in ambient air through the air passageway. Although not required, in some implementations, the nozzle can have an exhaust accelerating outlet section opposite the inlet section 30 to accelerate the exhaust. Acceleration of the exhaust can enhance the vacuum effect that is responsible for drawing in ambient air through the passageway. Air drawn through the passageway mixes with and cools the exhaust in a manner similar to that described above in relation to the device 110 of FIGS. 18-22.

Figure 28:
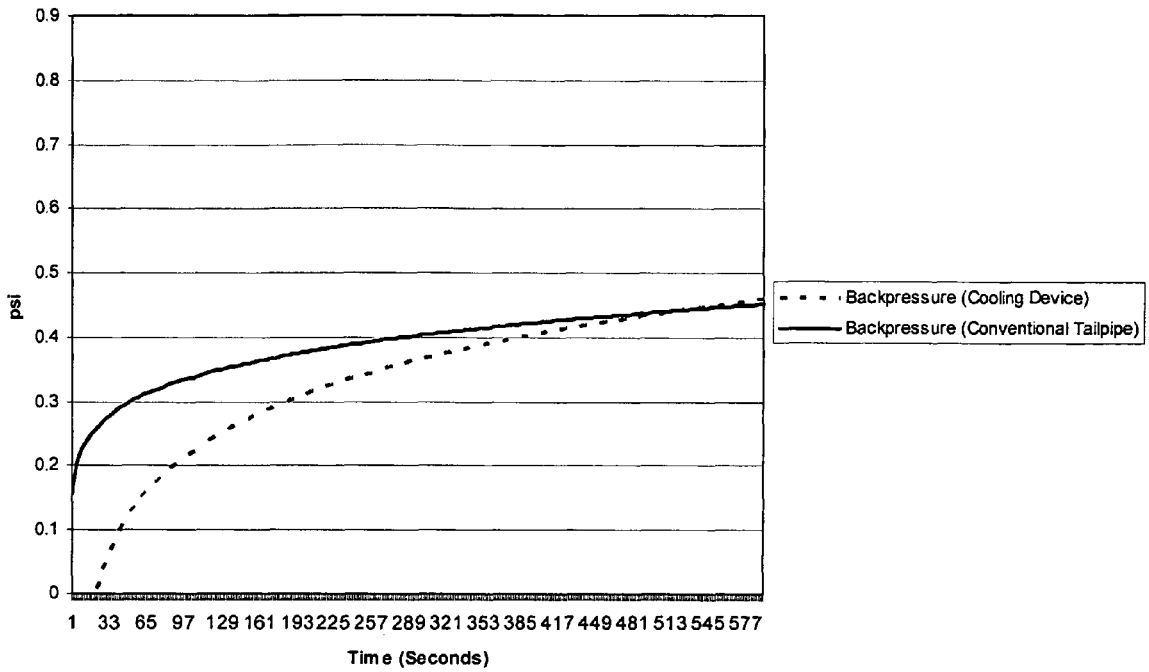
FIG. 28 is a graph showing the backpressure within an engine exhaust system employing an exhaust dilution and dispersion device versus an engine exhaust system employing a conventional tailpipe over time.

As was described above, providing a device with an elongate exhaust dispersion opening for providing a wide multi-directional dispersion of exhaust gas from the opening can also help to reduce backpressure in a vehicle's exhaust system. For example, as shown in FIG. 28, backpressure was measured at various time intervals during the running of a turbo-diesel engine for an exhaust dilution and dispersion device similar to the exemplary embodiment shown in FIGS. 18-20 and for a conventional tailpipe, such as shown in FIGS. 10 and 11. The backpressure in the exhaust system employing the exhaust dilution and dispersion device remained lower than the backpressure in the exhaust system using the conventional tailpipe during a substantial majority of the engine running time. Accordingly, providing an elongate exhaust dispersion opening as described herein can not only reduce the maximum temperature of exhaust expelled from the device at distances away from the device, but it can help facilitate a reduction in backpressure within the vehicle's exhaust system.

In certain implementations, multiple exhaust dilution and dispersion devices, such as devices 10, 110, 180, can be coupled to a vehicle's engine exhaust system, such as in a vertically stacked formation behind the vehicle.

The components of the exhaust dilution and dispersion device described herein can be made from a steel alloy, such as aluminated steel, or, in particularly high exhaust gas temperature applications, aluminated stainless steel. Other suitable durable heat tolerant materials can also be used.

Various manufacturing techniques can be used to make the exhaust dilution and dispersion device described herein, such as, for example, stamping, hydroforming, casting, machining, forging and molding. In some exemplary methods of manufacturing the exhaust dilution and dispersion device, the tailpipe can be formed from a length of pipe. The exhaust dispersion opening can be formed by cutting out or removing a section of the pipe while the exhaust deflection portion can be bent into the desired shape using hand tools and/or machines.

In view of the many possible embodiments to which the described principles may be applied, it should be recognized that the illustrated embodiments are only preferred examples and should not be taken as limiting the scope of the application. Rather, the scope is defined by the following claims. We therefore claim as our invention all that comes within the scope and spirit of these claims.

We claim:

1. A method of cooling exhaust from a vehicle, comprising:

receiving a flow of exhaust from an exhaust system of a vehicle;

downwardly deflecting at least a portion of the flow of exhaust;

separating at least a portion of the downwardly deflected flow of exhaust into at least two downwardly and laterally outwardly flowing exhaust portions, and increasing the separation of the at least two exhaust portions in the exhaust flow direction; and dispersing the flow of exhaust away from the vehicle, wherein dispersing the flow of exhaust comprises downwardly dispersing the flow of exhaust and laterally dispersing at least a major portion of the flow of exhaust.

2. The method of claim 1, wherein the act of separating comprises bifurcating at least a portion of the flow of exhaust into only two of such exhaust portions.

3. The method of claim 1, further comprising accelerating the flow of exhaust received from the exhaust system and mixing ambient air with the flow of exhaust prior to dispersing the exhaust.

4. The method of claim 3, further comprising decelerating the flow of exhaust after mixing ambient air with the flow of exhaust.

5. An exhaust cooling tailpipe for a vehicle, comprising:

a first generally tubular inlet portion with an exhaust inlet for coupling in exhaust receiving communication with an exhaust system of a vehicle; and a second outlet portion coupled to the inlet portion and comprising:

(i) a downwardly directed exhaust deflection portion having at least one inwardly projecting deflector with increasing interior surface areas in an exhaust flow direction and at least one outwardly projecting exhaust flow guide with decreasing cross-sectional areas in the exhaust flow direction; and (ii) an exhaust outlet in exhaust dispersing communication with the environment, the exhaust outlet comprising a generally elongate opening extending longitudinally along the tailpipe, the opening being at least partially coextensive with the downwardly directed exhaust deflection portion such that at least a major portion of the exhaust being dispersed through the opening has a sideways component.

6. The exhaust cooling tailpipe of claim 5, wherein a substantial portion of the perimeter of the exhaust outlet opening extends approximately parallel to a central axis of the tailpipe.

7. The exhaust cooling tailpipe of claim 5, wherein an inner surface of the inwardly projecting deflector defines an angle of between approximately 130° and approximately 150° with respect to a central axis of the tailpipe.

8. The exhaust cooling tailpipe of claim 5, wherein the tailpipe comprises a length of pipe having a generally cylindrical shape with a major diameter, and wherein the exhaust outlet opening has a width that is at least approximately 75% of the major diameter of the tailpipe.

9. The exhaust cooling tailpipe of claim 5, wherein the length of the elongate opening is at least approximately 1.5 times the width of the elongate opening.

10. The exhaust cooling tailpipe of claim 5, wherein the tailpipe comprises a length of pipe having a generally cylindrical shape with a major diameter, and wherein in profile the exhaust outlet opening has a height that is at least approximately 25% of the major diameter of the tailpipe.

11. An exhaust dilution and dispersion device for a vehicle, comprising:

a generally elongate tailpipe comprising:

(i) an inlet section adapted for receiving exhaust from an exhaust system of the vehicle when the exhaust dilution and dispersion device is mounted to the vehicle; and (ii) an outlet section in exhaust receiving communication with the inlet section, the outlet section comprising a downwardly directed exhaust deflection portion and an exhaust outlet in exhaust dispersing communication with the surroundings external to the device, the exhaust outlet comprising a generally elongate opening extending in a lengthwise direction;

wherein at least a portion of the exhaust outlet is coextensive with the downwardly directed exhaust deflection portion, and wherein when the exhaust dilution and dispersion device receives exhaust from the exhaust system of the vehicle, exhaust flows from the inlet section in an exhaust flow path and is directed at least in part by the deflection portion to the exhaust outlet with a major portion of the exhaust dispersed from the exhaust outlet having a transverse component; and the downwardly directed exhaust deflection portion comprising at least one exhaust flow guide divider portion extending along a major portion of the length of the exhaust outlet, the at least one exhaust flow guide divider portion projecting inwardly into the exhaust flow path so as to divide at least some of the exhaust flowing in the exhaust flow path when the exhaust dilution and dispersion device is mounted to the vehicle.

12. The exhaust dilution and dispersion device of claim 11, wherein the tailpipe comprises a length of pipe having a generally cylindrical shape with a major diameter, and wherein the elongate opening has a width that is at least approximately 75% of the major diameter of the tailpipe.

13. The exhaust dilution and dispersion device of claim 11, wherein the length of the elongate opening is at least approximately 1.5 times the height of the elongate opening.

14. The exhaust dilution and dispersion device of claim 11, wherein the length of the elongate opening is at least approximately 1.5 times the width of the elongate opening.

15. The exhaust dilution and dispersion device of claim 11, wherein the tailpipe comprises a length of pipe having a generally cylindrical shape with a major diameter, and wherein in profile the elongate opening has a height that is at least approximately 25% of the major diameter of the tailpipe.

16. The exhaust dilution and dispersion device of claim 11, wherein a substantial portion of the perimeter of the elongate opening extends approximately parallel to a central axis of the tailpipe.

17. The exhaust dilution and dispersion device of claim 11, wherein the elongate opening has a generally elongate inverted U-shaped side profile.

18. The exhaust dilution and dispersion device of claim 11, wherein the tailpipe comprises an inlet section end and an outlet section end, and wherein the downwardly directed exhaust deflection portion proximate the outlet section end defines an angle of between approximately 130° and approximately 150° with respect to a central axis of the tailpipe.

19. The exhaust dilution and dispersion device of claim 11, wherein the exhaust flow divider portion has an increasing cross sectional width in an exhaust flow direction and at least one outwardly projecting flow guide portion defining an exhaust flow channel having a decreasing cross-sectional width in the exhaust flow direction.

20. The exhaust dilution and dispersion device of claim 11, wherein the downwardly directed exhaust deflection portion comprises first and second exhaust flow guide portions separated from one another by one exhaust flow guide divider portion.

21. The exhaust dilution and dispersion device of claim 11 wherein the outlet section comprises first and second side edges that project inwardly along a major portion of the exhaust deflection portion to a lesser extent than the extent of inward projection of the exhaust flow divider portion.

22. The exhaust dilution and dispersion device of claim 11 wherein the exhaust deflection portion has an M-shaped cross-section.

23. The exhaust dilution and dispersion device of claim 11 wherein the exhaust deflection portion has an undulating cross-section.

24. The exhaust dilution and dispersion device of claim 11 wherein the exhaust flow guide divider portion is seamlessly connected to form a one piece construction.

25. The exhaust dilution and dispersion device of claim 11 wherein the exhaust flow guide divider portion extends inwardly into the exhaust flow continuously along its length.

26. The exhaust dilution and dispersion device of claim 11 wherein the exhaust flow guide divider portion extends inwardly a greater extent at one location further downstream in the exhaust flow path than at another location in the exhaust flow path that is upstream from said one location.

27. The exhaust dilution and dispersion device of claim 11, wherein the downwardly directed exhaust deflection portion is bifurcated by the exhaust flow guide divider portion and wherein the deflection portion defines at least one exhaust flow guide portion extending along a side of the exhaust flow guide divider portion.

28. The exhaust dilution and dispersion device of claim 27, wherein the deflection portion has at least one symmetry plane extending lengthwise through the exhaust flow guide divider portion.

29. The exhaust dilution and dispersion device of claim 27, wherein the exhaust flow divider portion has a lower surface that is generally convex and the at least one exhaust flow guide portion has a lower surface that is generally concave.

30. The exhaust dilution and dispersion device of claim 11 wherein the exhaust flow divider portion is of increasing cross sectional width from a first location to a second location in the exhaust flow direction.

31. The exhaust dilution and dispersion device of claim 30 comprising first and second exhaust flow guides along the respective sides of the exhaust flow divider portion, the exhaust flow guides being of decreasing cross sectional area from the first location to the second location.

32. The exhaust dilution and dispersion device of claim 31 wherein the exhaust flow divider portion is generally convex in cross section and the exhaust flow guides are generally concave in cross section.

33. The exhaust dilution and dispersion device of claim 11, further comprising a nozzle having a first inlet end portion connectable to an exhaust system of a vehicle and a second exhaust acceleration end portion generally opposite the first inlet end portion, the second exhaust acceleration end portion comprising reduced cross-sectional areas in an exhaust flow direction, wherein the second exhaust acceleration end portion of the nozzle is at least partially disposed within the inlet section of the tailpipe such that an ambient air passageway is defined between an outer surface of the nozzle and an inner surface of the tailpipe, the air passageway facilitating passage of ambient air from the surroundings into exhaust flowing through the tailpipe.

34. The exhaust dilution and dispersion device of claim 33, wherein the tailpipe has an overall length, and wherein the exhaust outlet has a length that is at least approximately 50% of the length of the tailpipe.

35. The exhaust dilution and dispersion device of claim 33, wherein the inlet section of the tailpipe comprises a diffusion section having increasing cross-sectional areas in the exhaust flow direction.

36. The exhaust dilution and dispersion device of claim 33, further comprising a plurality of connection structures coaxially coupling the nozzle and the tailpipe, the connection structures being generally elongated and extending in a direction generally parallel to a central axis of the nozzle and the tailpipe.

37. The exhaust dilution and dispersion device of claim 33, further comprising a plurality of connection structures coaxially coupling the nozzle and the tailpipe together, at least one of the connection structures being generally elongated and having a turbulence inducing portion that is not parallel to a central axis of the tailpipe.

38. The exhaust dilution and dispersion device of claim 33, wherein the ambient air passageway is generally annularly-shaped.

* * * * *